US010566723B2

(12) United States Patent
Ueda et al.

(10) Patent No.: US 10,566,723 B2
(45) Date of Patent: Feb. 18, 2020

(54) CONNECTOR, AND HEADER AND SOCKET WHICH ARE USED IN CONNECTOR

(71) Applicant: Panasonic Intellectual Property Management Co., Ltd., Osaka (JP)

(72) Inventors: Hiroki Ueda, Mie (JP); Kohsuke Yoshioka, Mie (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/779,919

(22) PCT Filed: Dec. 27, 2016

(86) PCT No.: PCT/JP2016/005235
§ 371 (c)(1),
(2) Date: May 30, 2018

(87) PCT Pub. No.: WO2017/134719
PCT Pub. Date: Aug. 10, 2017

(65) Prior Publication Data

US 2018/0323527 A1 Nov. 8, 2018

(30) Foreign Application Priority Data

Feb. 5, 2016 (JP) ..... 2016-021136

(51) Int. Cl.
*H01R 13/11* (2006.01)
*H01R 107/00* (2006.01)

(52) U.S. Cl.
CPC ..... *H01R 13/11* (2013.01); *H01R 2107/00* (2013.01)

(58) Field of Classification Search
CPC ..... H01R 13/11; H01R 13/24; H01R 13/20; H01R 13/115; H01R 2107/00
See application file for complete search history.

(56) References Cited

U.S. PATENT DOCUMENTS 5,139,427 A * 8/1992 Boyd ..... H01R 12/52 439/247
7,427,203 B2 * 9/2008 Liao ..... H01R 12/57 439/66

(Continued)

FOREIGN PATENT DOCUMENTS

CN 104916936 A 9/2015
JP 2004-111081 4/2004

(Continued)

OTHER PUBLICATIONS

International Search Report of PCT application No. PCT/JP2016/005235 dated Mar. 21, 2017.

*Primary Examiner* — Edwin A. Leon
*Assistant Examiner* — Milagros Jeancharles
(74) *Attorney, Agent, or Firm* — Greenblum & Bernstein, P.L.C.

(57) ABSTRACT

A connector is configured such that a socket housing is engaged with a header housing as to cause a socket-side signal terminal to contact a header-side signal terminal and as to cause a socket-side power source terminal to contact a header-side power source terminal. The socket-side signal terminal and the socket-side power source terminal are arranged in a longitudinal direction of the socket housing. In the socket-side power source terminal and the header-side power source terminal, contact portions to contact each other are arranged in the longitudinal direction of the socket housing. Three tongues are formed in the socket-side power source terminal. The contact portions are provided at the three tongues, respectively.

6 Claims, 41 Drawing Sheets

(56) References Cited

U.S. PATENT DOCUMENTS

| | | | | |
|---|---|---|---|---|
| 2013/0295784 | A1* | 11/2013 | Hasegawa | H01R 12/716<br>439/55 |
| 2014/0120784 | A1 | 5/2014 | Tai et al. | |
| 2015/0380845 | A1 | 12/2015 | Goto et al. | |
| 2017/0194727 | A1* | 7/2017 | Yoshioka | H01R 12/716 |
| 2017/0365944 | A1* | 12/2017 | Yoshioka | H01R 12/71 |

FOREIGN PATENT DOCUMENTS

| | | |
|---|---|---|
| JP | 2005-019144 | 1/2005 |
| JP | 2016-006751 A | 1/2016 |
| JP | 2016-012470 | 1/2016 |

* cited by examiner

CONNECTOR, AND HEADER AND SOCKET WHICH ARE USED IN CONNECTOR

This application is a U.S. national stage application of the PCT international application No. PCT/JP2016/005235 filed on Dec. 27, 2016, which claims the benefit of foreign priority of Japanese patent application No. 2016-021136 filed on Feb. 5, 2016, the contents all of which are incorporated herein by reference.

TECHNICAL FIELD

The present invention relates to a connector, and a header and a socket which are used in the connector.

BACKGROUND ART

A conventional connector including a socket having a socket main body and socket-side terminals disposed in the socket main body and a header including a header main body and header-side terminals disposed in the header main body is known (for example, refer to PTL 1).

In PTL 1, the socket is engaged with the header to cause corresponding terminals to electrically contact each other, thereby electrically connect circuit patterns of a circuit board to each terminal.

A connector in which groups each including a socket-side terminal and a header-side terminal electrically connected to the socket-side terminal is known.

The groups of the terminals are generally used as signal terminals to which a signal line is connected. But a part of the groups of the terminals may be used as a power source terminal to which a power source line is connected.

CITATION LIST

Patent Literature

PTL 1: Japanese Patent Laid-Open Publication No. 2005-019144

SUMMARY

A connector according to the present disclosure includes a socket including a substantially rectangular socket housing in which a socket-side signal terminal and a socket-side power source terminal are disposed and a header including a substantially rectangular header housing in which a header-side signal terminal and a header-side power source terminal are disposed. The socket housing is engaged with the header housing as to cause the socket-side signal terminal to contact the header-side signal terminal and as to cause the socket-side power source terminal to contact the header-side power source terminal. The socket-side signal terminal and the socket-side power source terminal are arranged in a longitudinal direction of the socket housing. In the socket-side power source terminal and the header-side power source terminal, contact portions contact each other are arranged in the longitudinal direction of the socket housing. Three tongues are formed in the socket-side power source terminal. The contact portions are provided at the three tongues, respectively.

The connector of the present disclosure, and the header and the socket which are used in the connector have high contact reliability between the terminals.

DETAIL DESCRIPTION OF PREFERRED EMBODIMENTS

Figure 1:
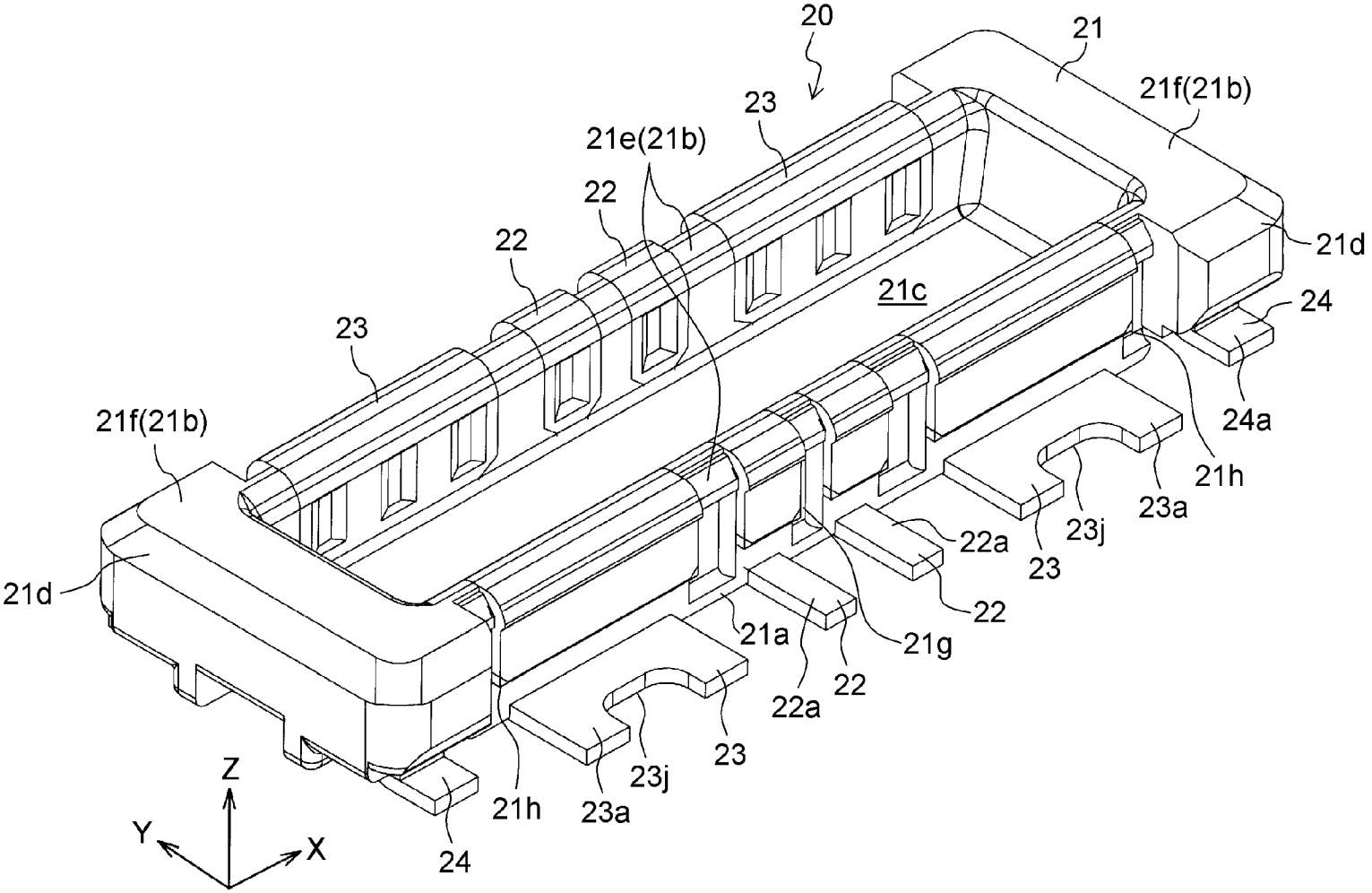
FIG. 1 is a perspective view of a header of a connector according to an exemplary embodiment of the present invention viewing from a rear surface side.
Figure 2:
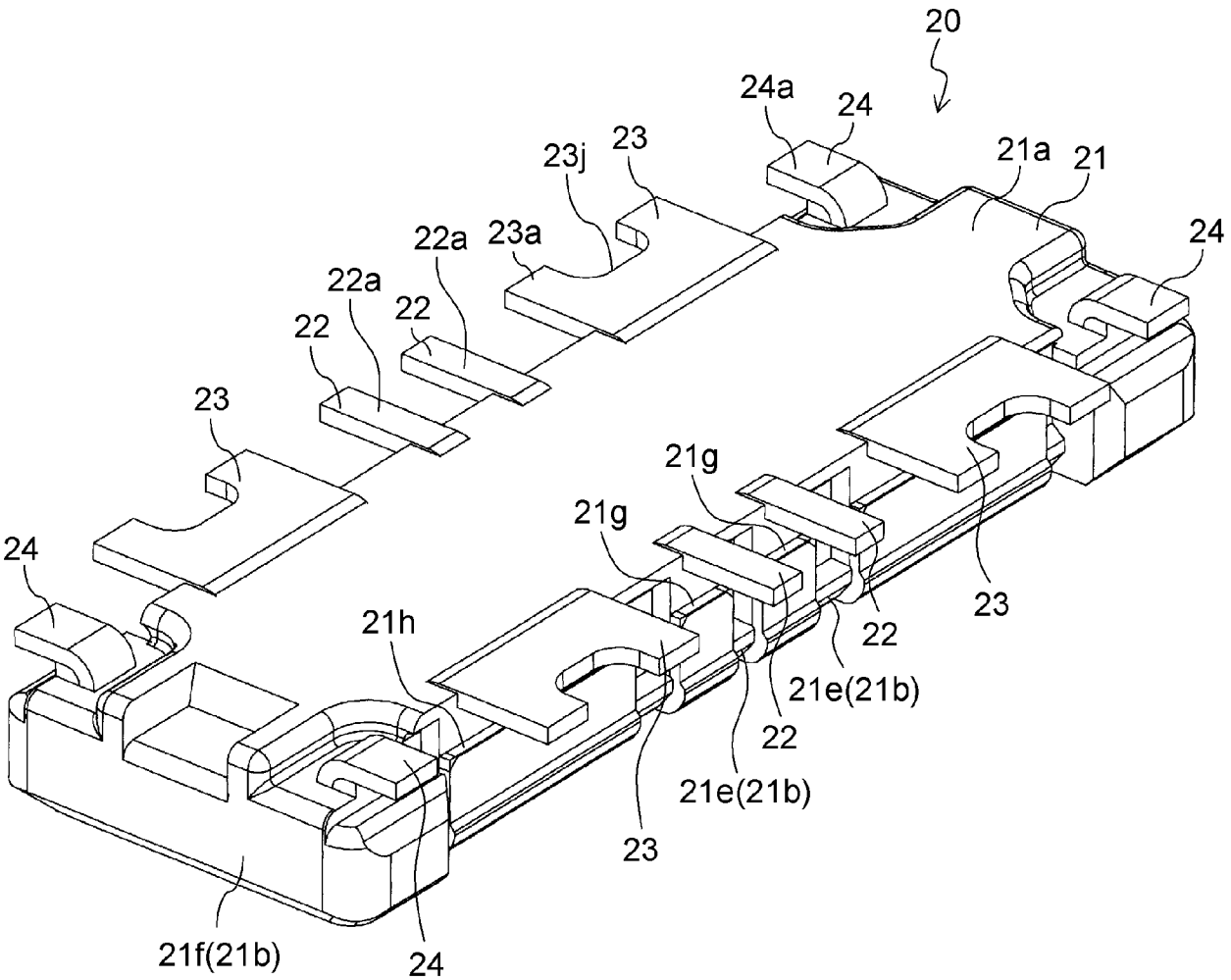
FIG. 2 is a perspective view of the header of the connector according to the embodiment of the present invention viewing from a front surface side.
Figure 3:
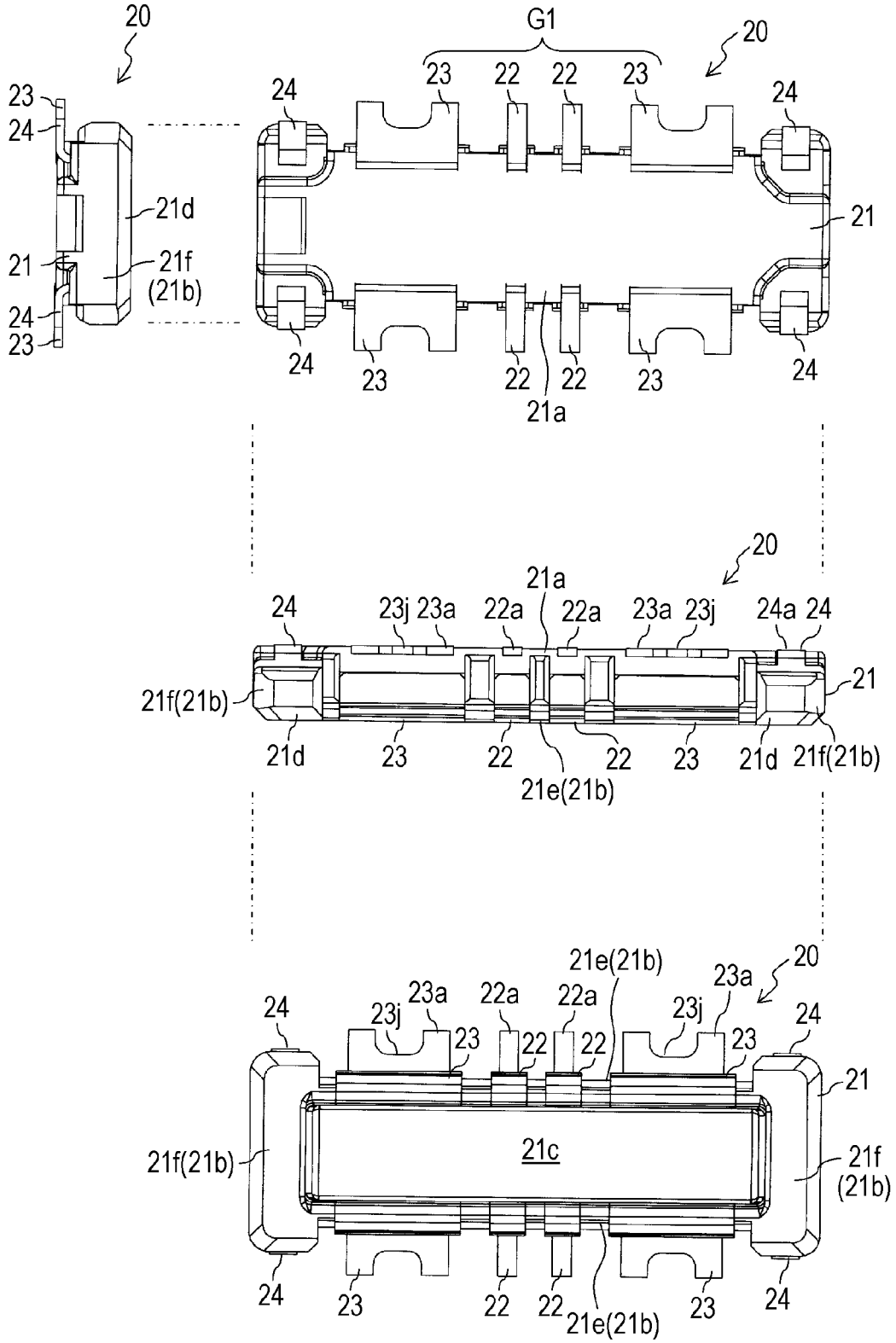
FIG. 3 illustrates the header of the connector according to the embodiment of the present invention.

In the above conventional connector, since a current supplied from the power source line is larger than a current supplied from the signal line, in the case where a part of the terminal is used as a power source terminal, one power source terminal is employed by using the plurality of terminals together, and it is necessary to ensure a necessary current capacity.

In the connector which allows the corresponding terminals to electrically contact each other, a contact reliability between the terminals preferably increases.

An embodiment of the present invention will be detailed with reference to drawings below. Hereinafter, the longitudinal direction of the connector (a header-side housing and a socket-side housing) is an X direction, the width direction (lateral direction) of the connector (the header-side housing and the socket-side housing) is a Y direction, and the upward-and-downward direction of the connector in FIGS. 29 to 32 is a Z direction in the description. The socket and the header will be described while considering an upper side as an upper side (front surface side) in the upward-and-downward direction, and a lower side as a lower side (rear surface side) in the upward-and-downward direction in a state illustrated in FIGS. 29 to 32.

First, connector 10 according to the embodiment will be briefly described with reference to FIGS. 29 to 32.

Connector 10 according to the embodiment includes header 20 and socket 30 engaged with header 20 as illustrated in FIGS. 29 to 32. In accordance with the embodiment, header 20 includes header housing 21 in which header-side signal terminal 22 and header-side power source terminal 23 are disposed. Meanwhile, socket 30 has socket housing 31 in which socket-side signal terminal 32 and socket-side power source terminal 33 are disposed.

Header housing 21 is engaged with socket housing 31 as to cause header-side signal terminal 22 to contact socket-side signal terminal 32, and as to cause header-side power source terminal 23 to contact socket-side power source terminal 33.

Header 20 is mounted onto second circuit board 40. socket 30 is mounted onto first circuit board 60.

Therefore, when header 20 is engaged with socket 30, second circuit board 40 on which header 20 is mounted is electrically connected to first circuit board 60 on which socket 30 is mounted.

Specifically, header 20 according to the embodiment is mounted on second circuit board 40 as to electrically connect header-side signal terminal 22 and header-side power source terminal 23 to circuit pattern 41 on second circuit board 40. As second circuit board 40, a printed circuit board or a flexible printed circuit (FPC) can be used.

Socket 30 according to the embodiment is mounted on first circuit board 60 as to electrically connect socket-side signal terminal 32 and socket-side power source terminal 33 to circuit pattern 61 on first circuit board 60. As first circuit board 60, a printed circuit board or a flexible printed circuit (FPC) can be used.

Connector 10 according to the embodiment may be used for electrically connecting the circuit boards to each other in an electronic device which serves as a portable terminal, such as a smartphone. However, the connector of the present invention may be used in electrical connection between any components if the connector is used in the electronic device.

Next, a configuration of header 20 of connector 10 will be described with reference to FIGS. 1 to 14.

Header 20 includes header housing 21 as described above. In accordance with the embodiment, header housing 21 has an oblong rectangular shape as a whole in a plan view and is made of insulating synthetic resin (refer to FIGS. 1 to 6).

In header housing 21, header-side signal terminal 22 and header-side power source terminal 23 which are made of metal are disposed.

Header-side signal terminal 22 is a terminal configured to be electrically connected to a signal line, and is used for transmitting a signal.

Header-side power source terminal 23 is a terminal which is configured to be electrically connected to a power source line and is used for supplying electric power.

In accordance with the embodiment, two header-side signal terminals 22 and two header-side power source terminals 23 are arranged along one long side of header housing 21, such that one header-side signal terminal 22 and two header-side power source terminals 23 are separated from each other. Two header-side signal terminals 22 and two header-side power source terminals 23 which are disposed at one side of header housing 21 in the width direction (lateral direction) Y of header housing 21 constitute header-side terminal group G1.

One header-side signal terminal 22 and two header-side power source terminals 23 are arranged along another long side of header housing 21 such that one header-side signal terminal 22 and two header-side power source terminals 23 are separated from each other. One header-side signal terminal 22 and two header-side power source terminals 23 which are disposed at another side of header housing 21 in the width direction Y (a lateral direction) of header housing 21 constitute another header-side terminal group G1.

In accordance with the embodiment, two rows (plural rows) of header-side terminal groups G1 each including header-side signal terminal 22 and header-side power source terminal 23 which are arranged in longitudinal direction X of header housing 21 are disposed in header housing 21.

Header-side power source terminals 23 are respectively disposed at both ends of header-side signal terminal 22 in one row of header-side terminal group G1. In other words, header-side power source terminals 23 are disposed at both ends of header housing 21 in longitudinal direction X while two header-side signal terminals 22 are disposed between header-side power source terminals 23. In accordance with the embodiment, header-side power source terminal 23 is disposed more outside in the longitudinal direction X of header housing 21 than header-side signal terminal 22.

In accordance with the embodiment, header-side holder brackets 24 made of metal are disposed at both ends of header housing 21 in longitudinal direction X. Header-side holder bracket 24 is used for increasing the strength of header housing 21 and for fixing mounting terminal 24*a* provided in header-side holder bracket 24 to second circuit board 40 described above.

Figure 4:
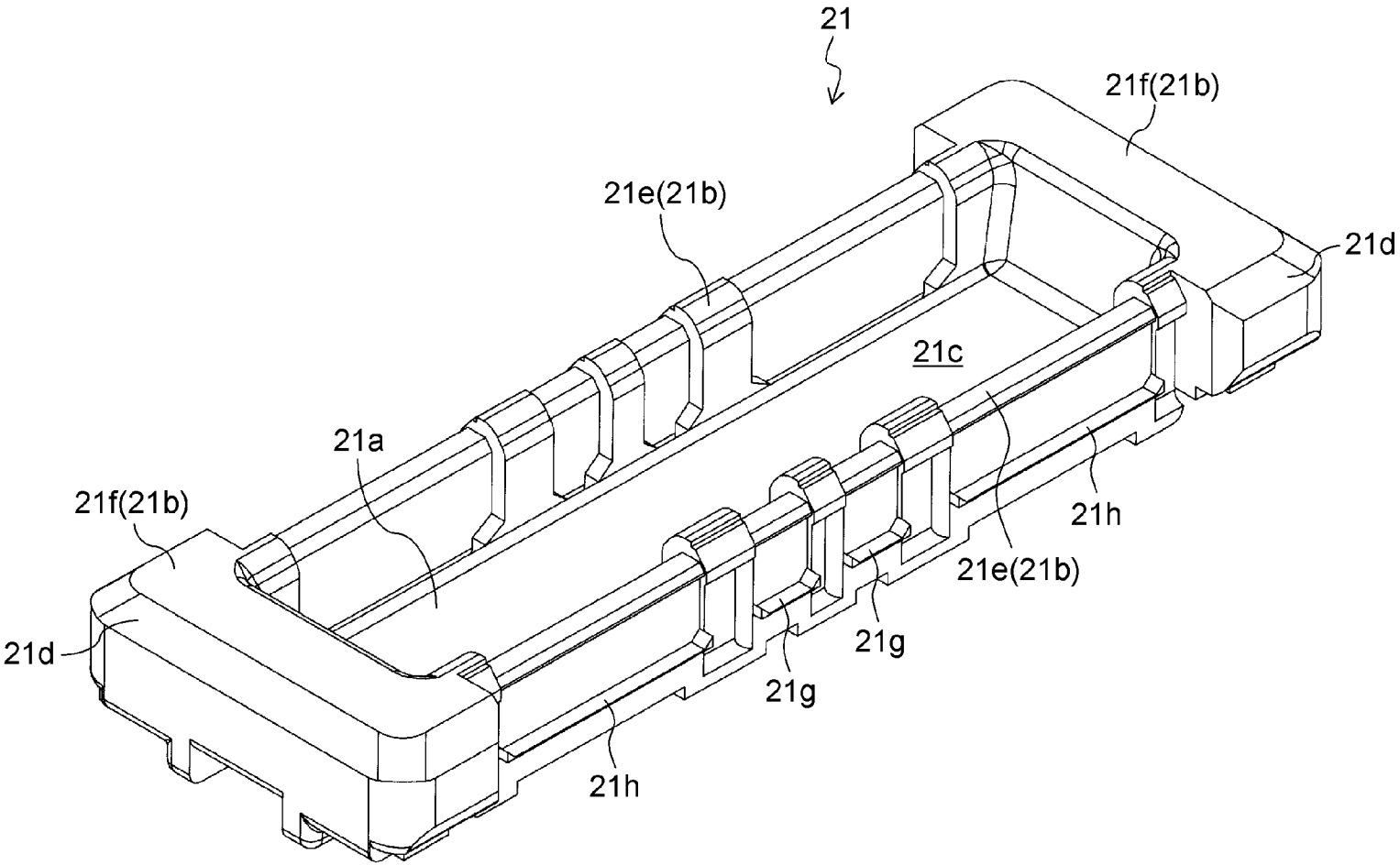
FIG. 4 is a perspective view of a header housing of the connector according to the embodiment of the present invention viewing from the rear surface side.
Figure 5:
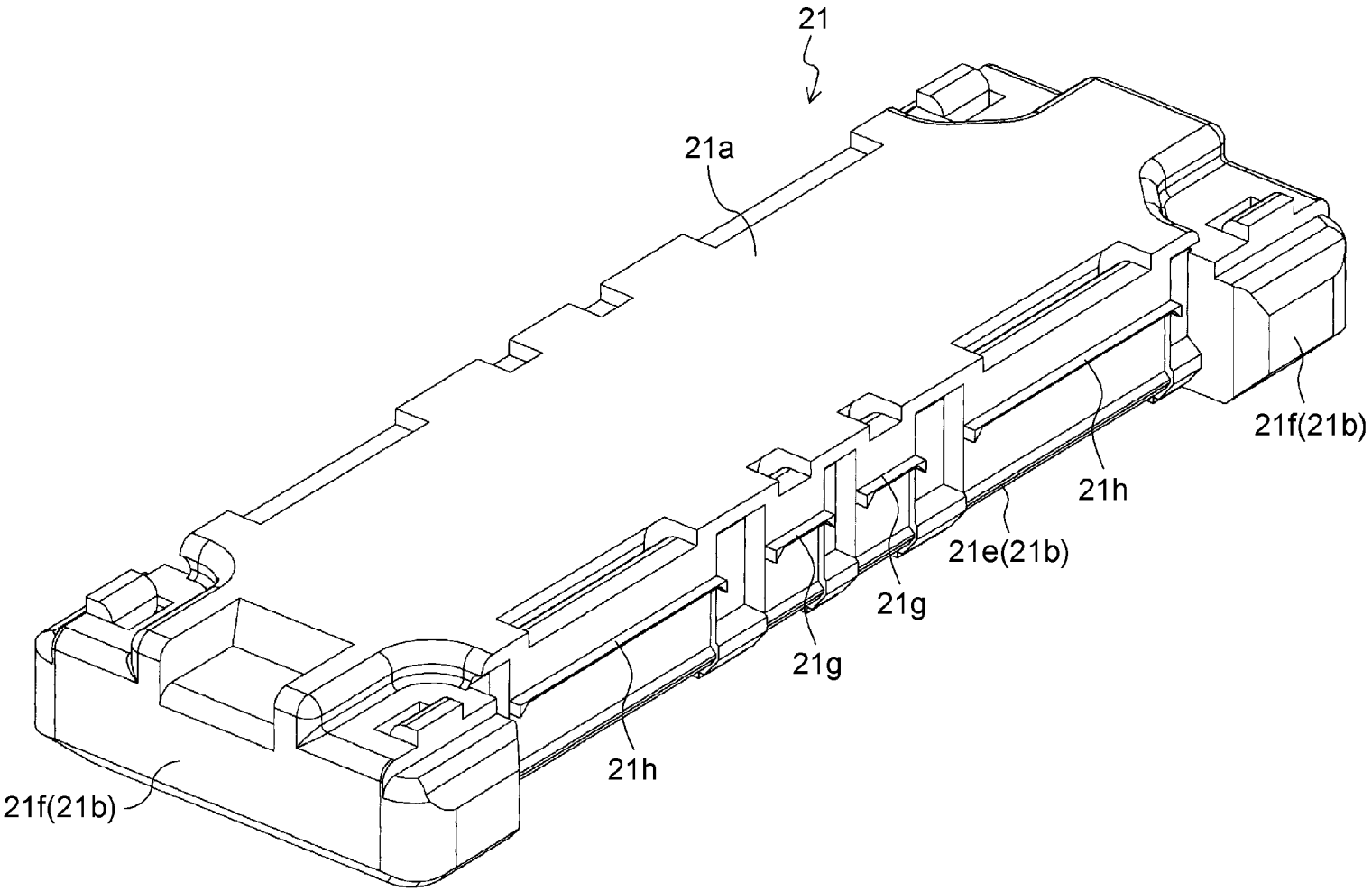
FIG. 5 is a perspective view of the header housing of the connector according to the embodiment of the present invention viewing from the front surface side.
Figure 6:
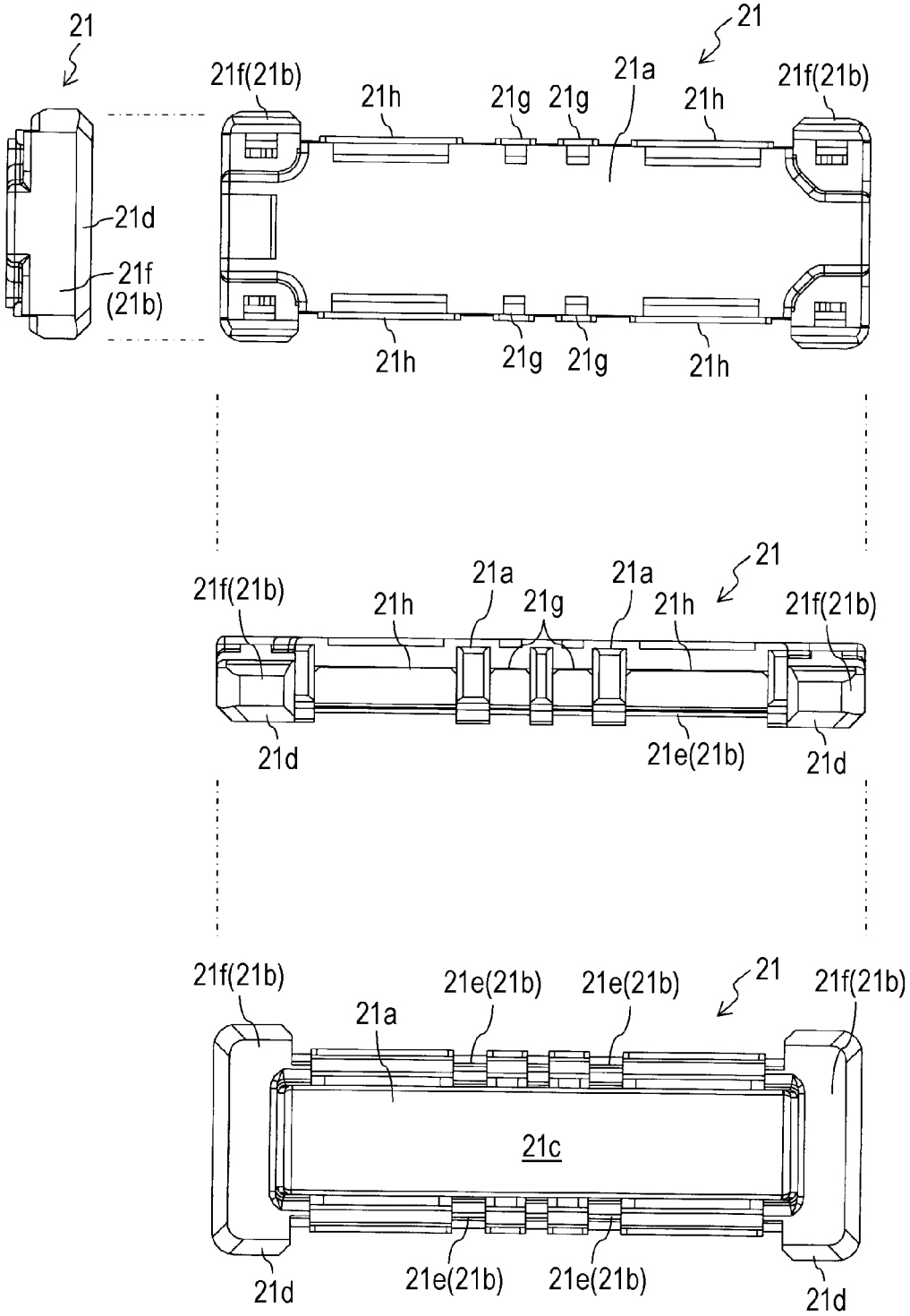
FIG. 6 illustrates the header housing of the connector according to the embodiment of the present invention.
Figure 7A:
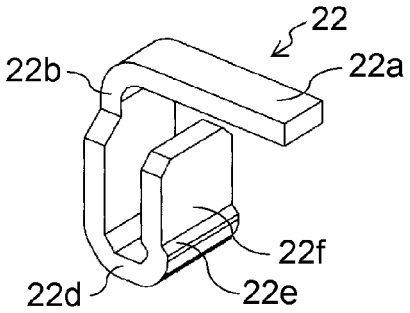
FIG. 7A is a first perspective view of a header-side signal terminal of the connector according to the embodiment of the present invention.
Figure 7B:
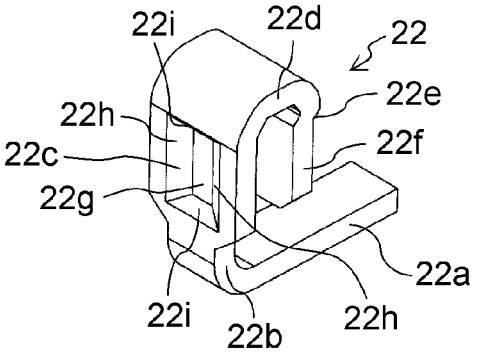
FIG. 7B is a second perspective view of the header-side signal terminal of the connector according to the embodiment of the present invention.
Figure 7C:
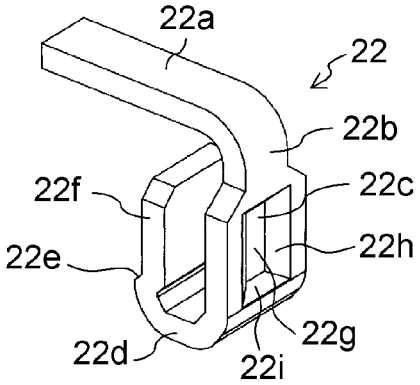
FIG. 7C is a third perspective view of the header-side signal terminal of the connector according to the embodiment of the present invention.
Figure 7D:
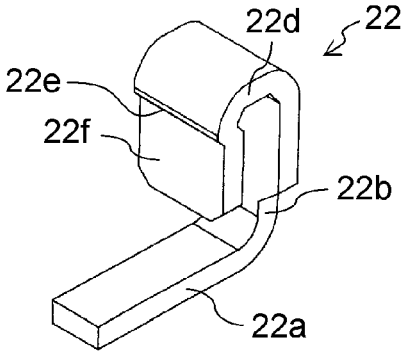
FIG. 7D is a fourth perspective view of the header-side signal terminal of the connector according to the embodiment of the present invention.
Figure 8:
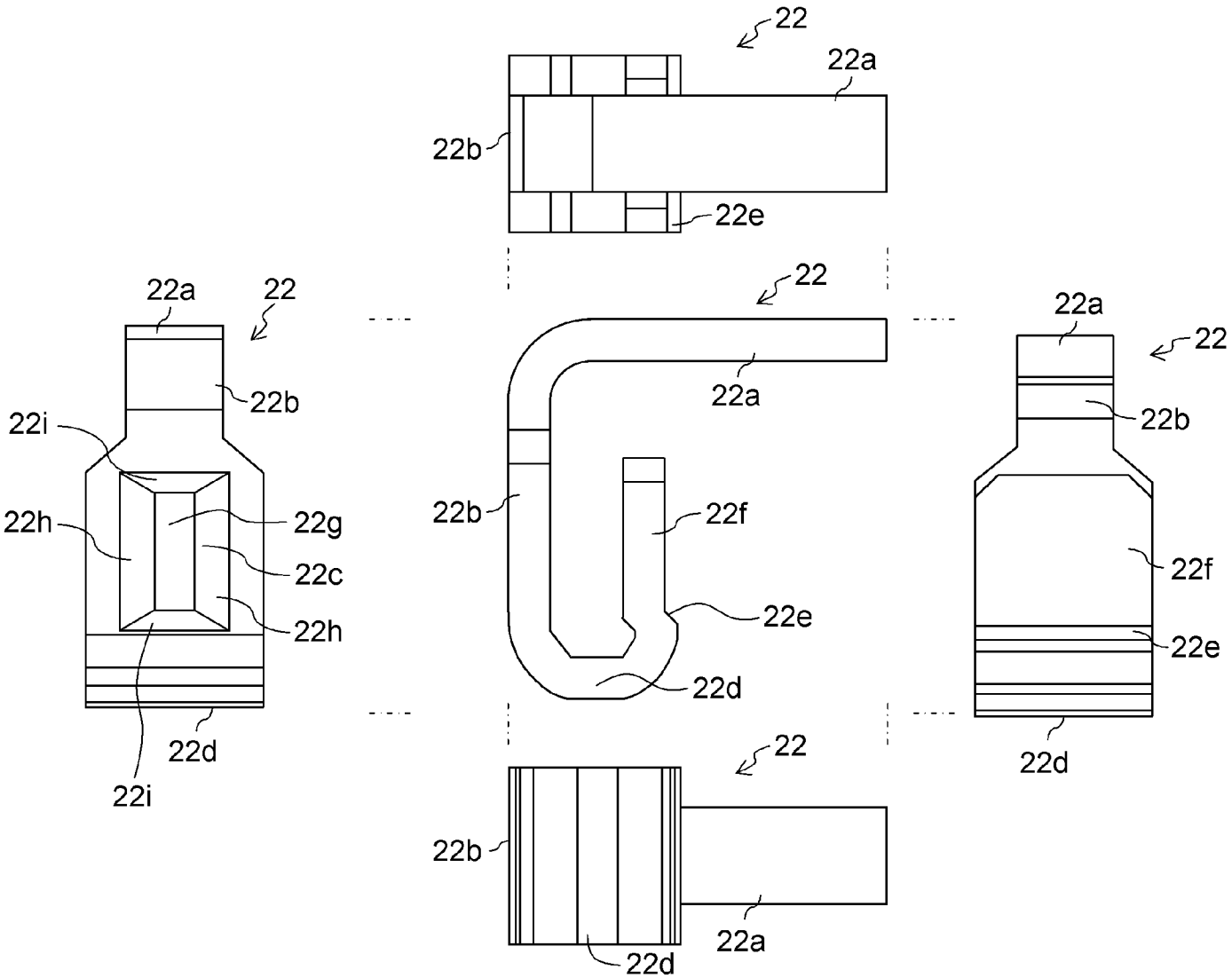
FIG. 8 illustrates the header-side signal terminal of the connector according to the embodiment of the present invention.
Figure 9A:
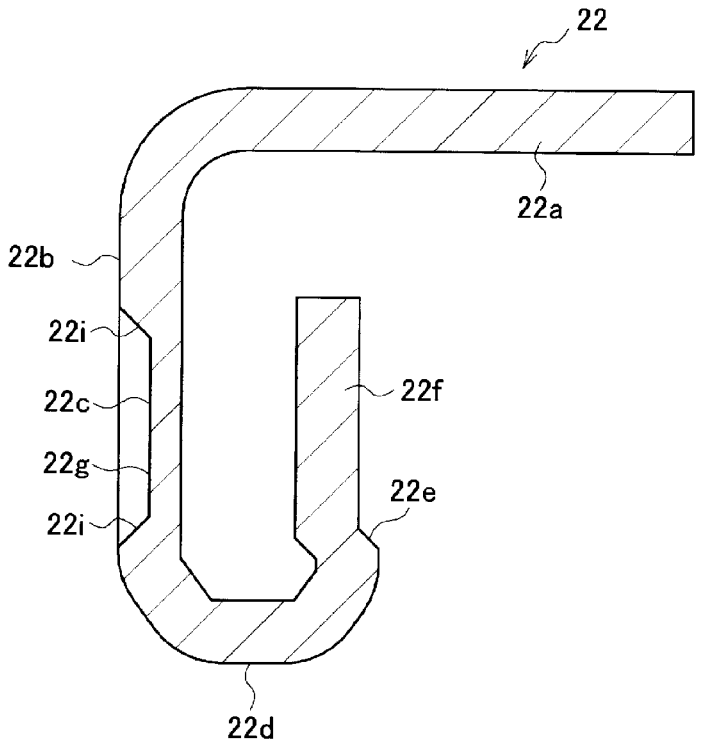
FIG. 9A is a side sectional view of the header-side signal terminal of the connector according to the embodiment of the present invention.
Figure 9B:
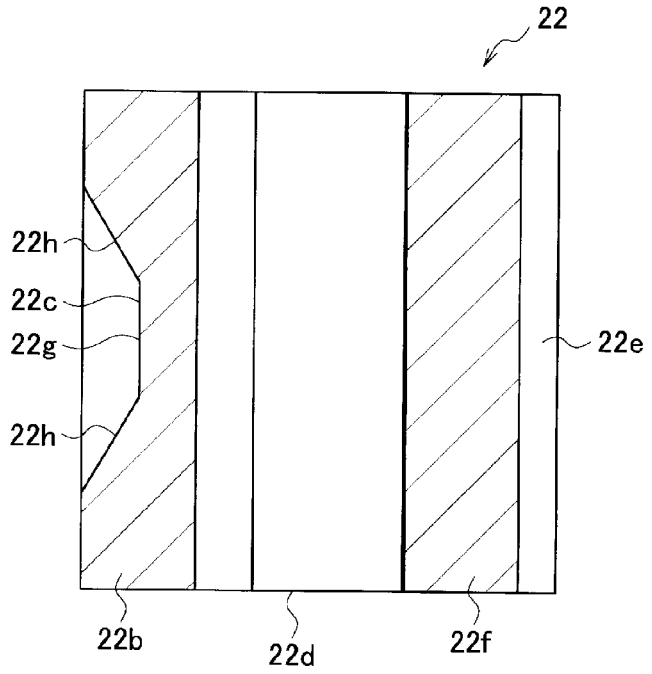
FIG. 9B is a lateral sectional view of the header-side signal terminal of the connector according to the embodiment of the present invention.
Figure 10A:
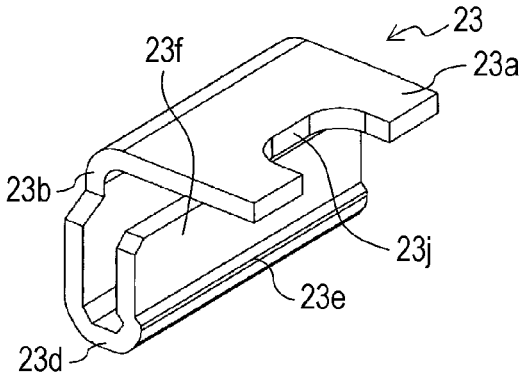
FIG. 10A is a first perspective view of a header-side power source terminal of the connector according to the embodiment of the present invention.
Figure 10B:
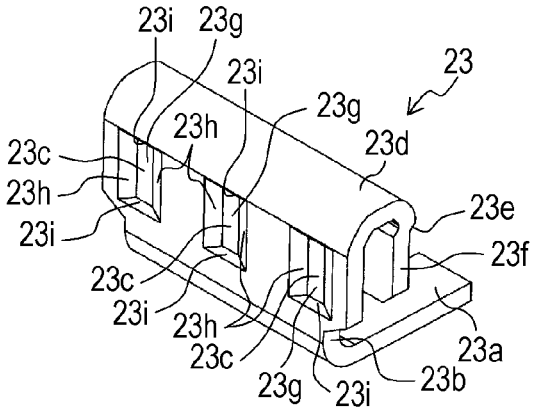
FIG. 10B is a second perspective view of the header-side power source terminal of the connector according to the embodiment of the present invention.
Figure 10C:
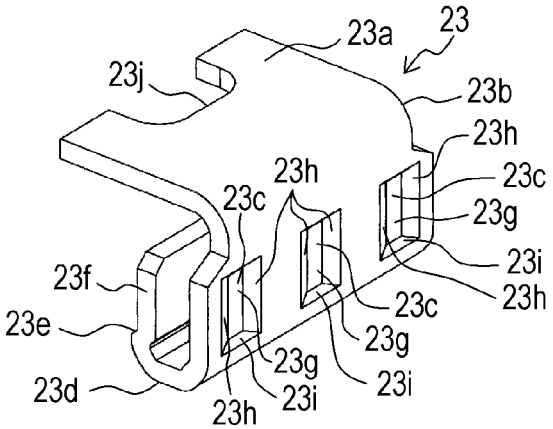
FIG. 10C is a third perspective view of the header-side power source terminal of the connector according to the embodiment of the present invention.
Figure 10D:
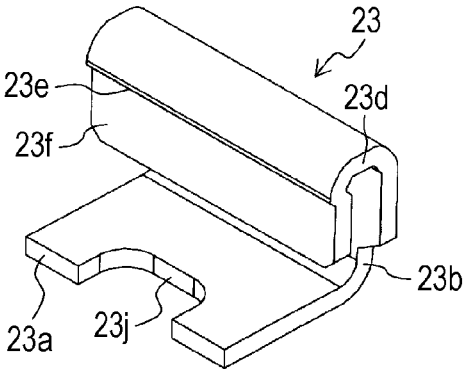
FIG. 10D is a fourth perspective view of the header-side power source terminal of the connector according to the embodiment of the present invention.
Figure 11:
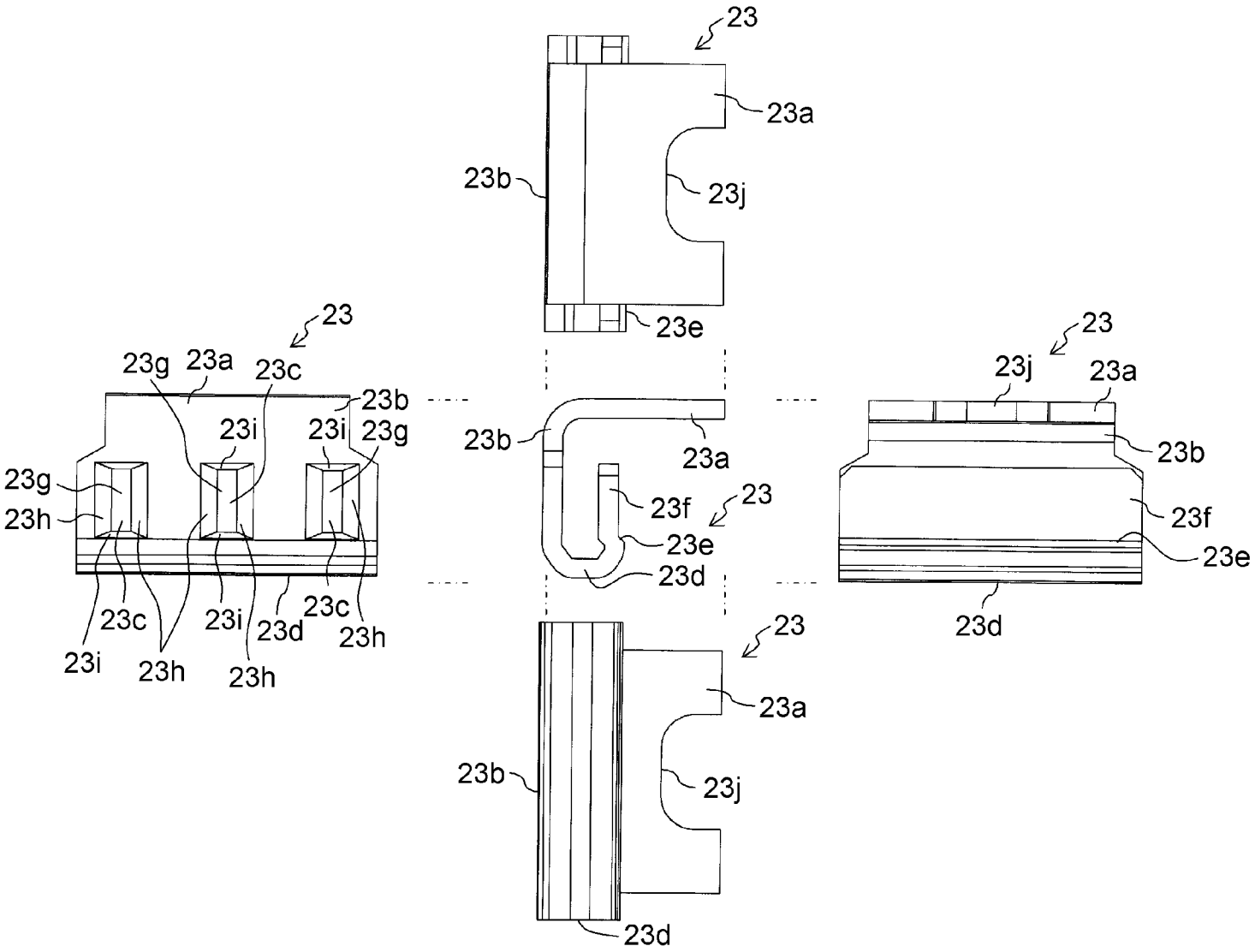
FIG. 11 illustrates the header-side power source terminal of the connector according to the embodiment of the present invention.
Figure 12A:
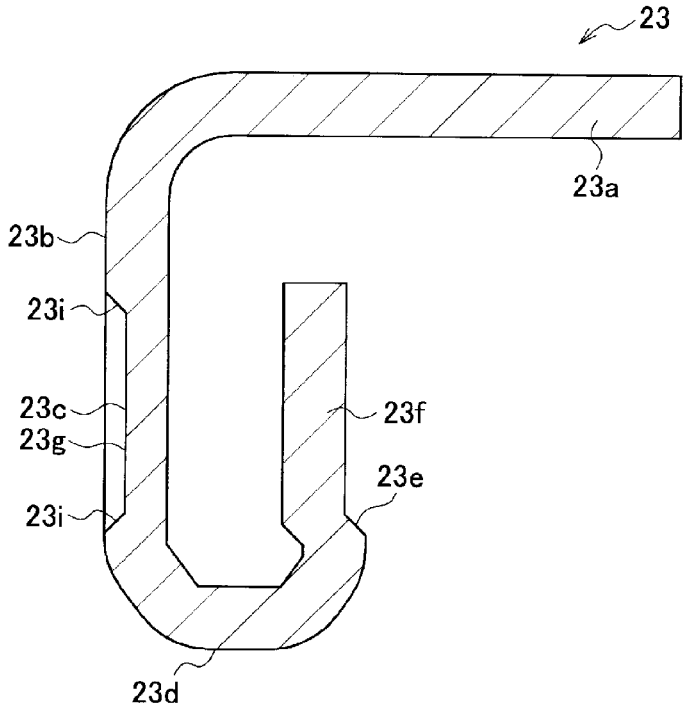
FIG. 12A is a side sectional view of the header-side power source terminal of the connector according to the embodiment of the present invention.
Figure 12B:
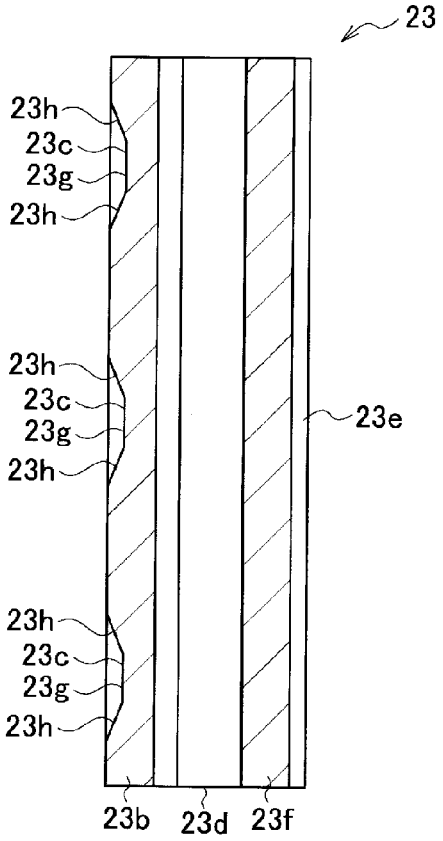
FIG. 12B is a lateral sectional view of the header-side power source terminal of the connector according to the embodiment of the present invention.
Figure 13A:
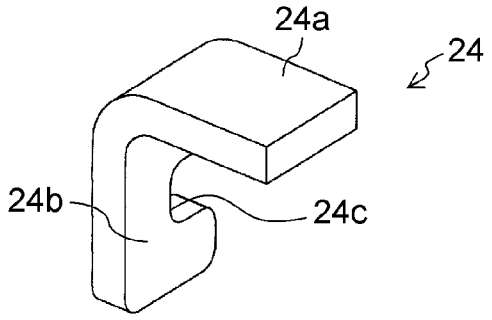
FIG. 13A is a first perspective view of a header-side holder bracket of the connector according to the embodiment of the present invention.
Figure 13B:
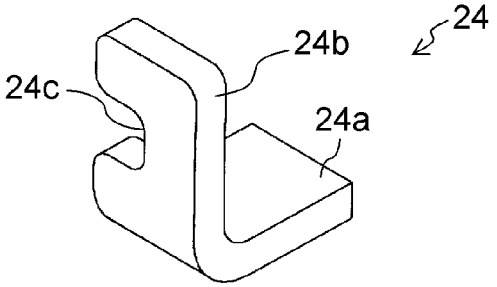
FIG. 13B is a second perspective view of the header-side holder bracket of the connector according to the embodiment of the present invention.
Figure 13C:
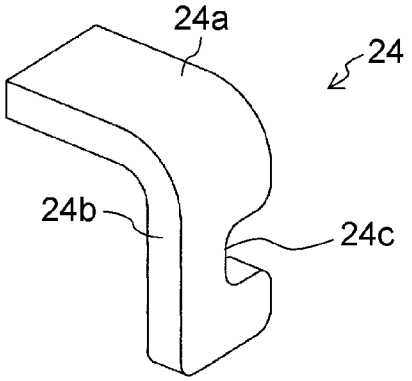
FIG. 13C is a third perspective view of the header-side holder bracket of the connector according to the embodiment of the present invention.
Figure 13D:
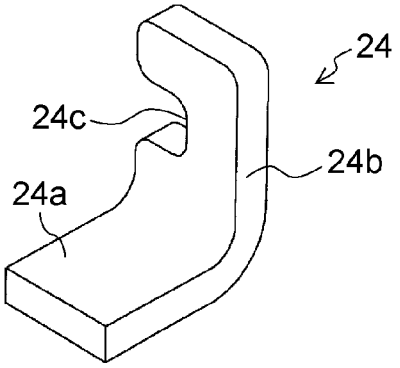
FIG. 13D is a fourth perspective view of the header-side holder bracket of the connector according to the embodiment of the present invention.
Figure 14:
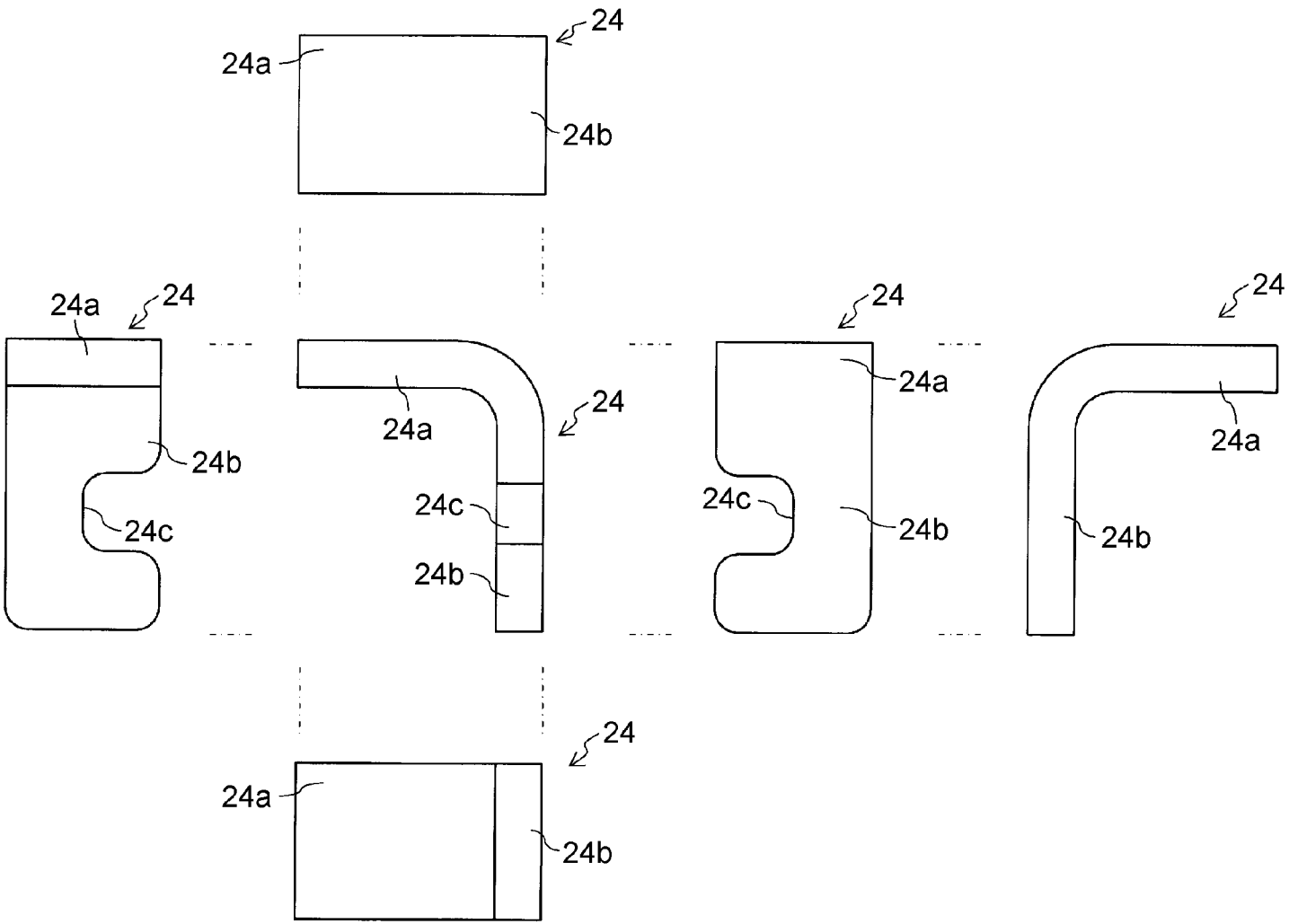
FIG. 14 illustrates the header-side holder bracket of the connector according to the embodiment of the present invention.
Figure 15:
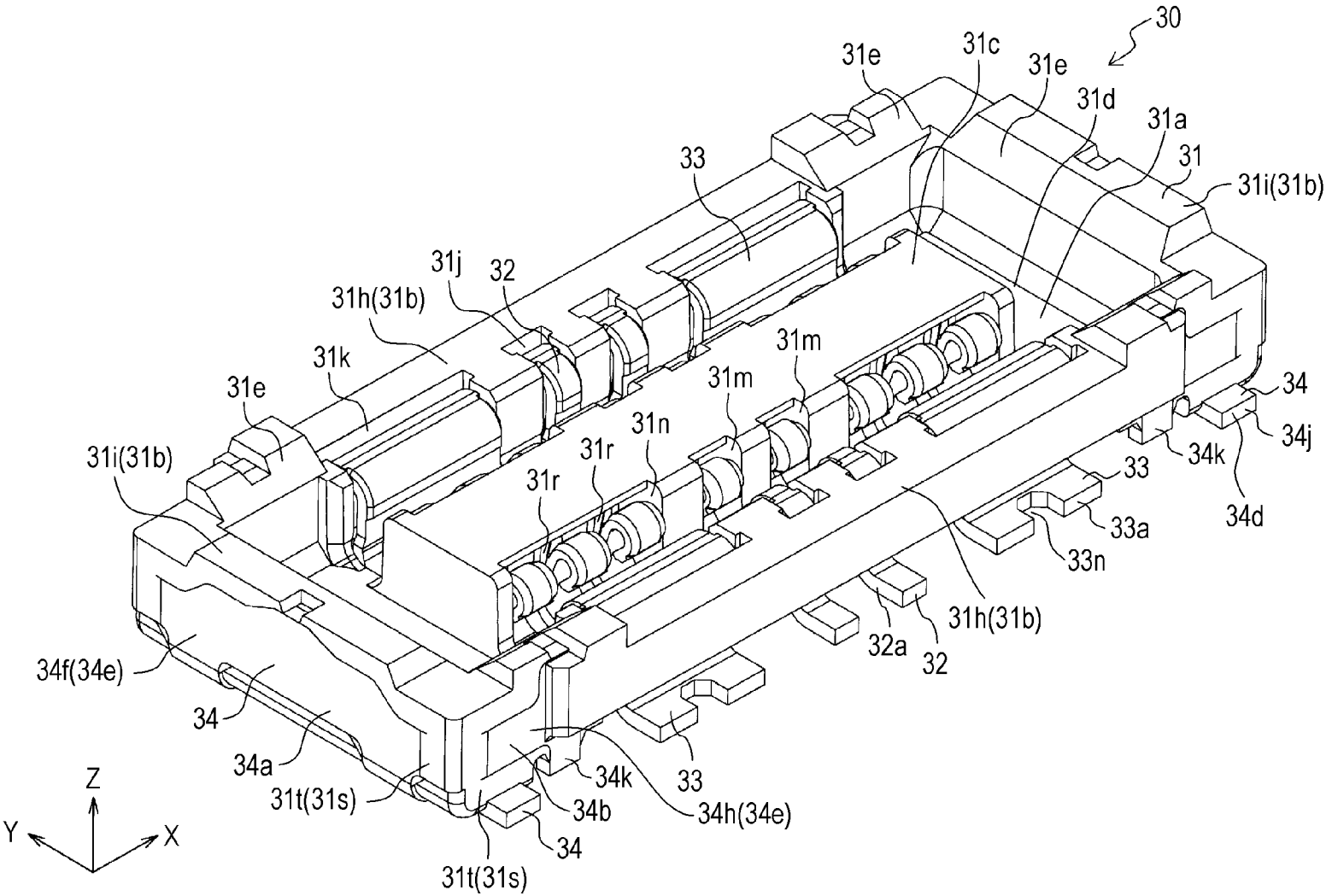
FIG. 15 is a perspective view of a socket of the connector according to the embodiment of the present invention viewing from the front surface side.
Figure 16:
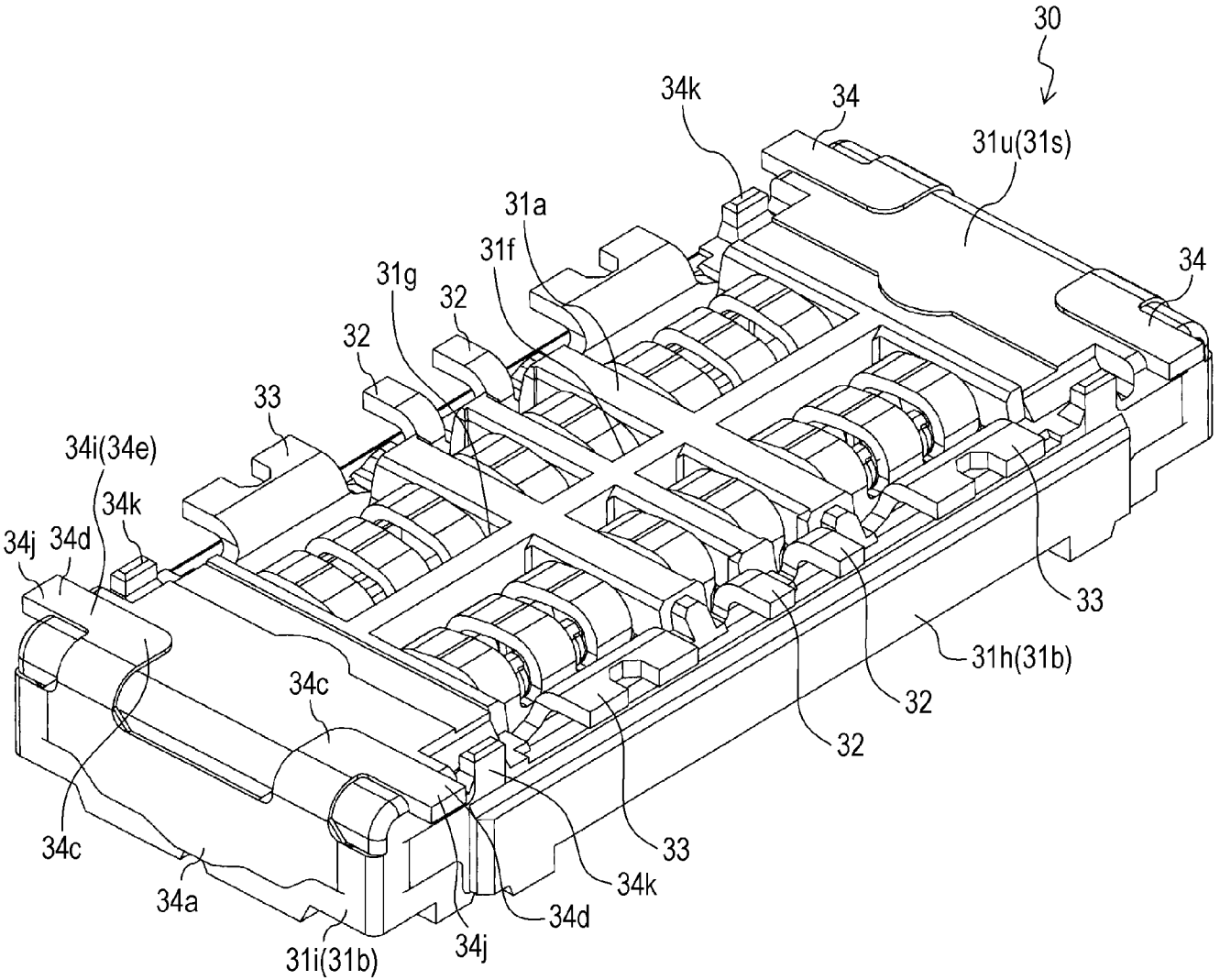
FIG. 16 is a perspective view of the socket of the connector according to the embodiment of the present invention viewing from the rear surface side.
Figure 17:
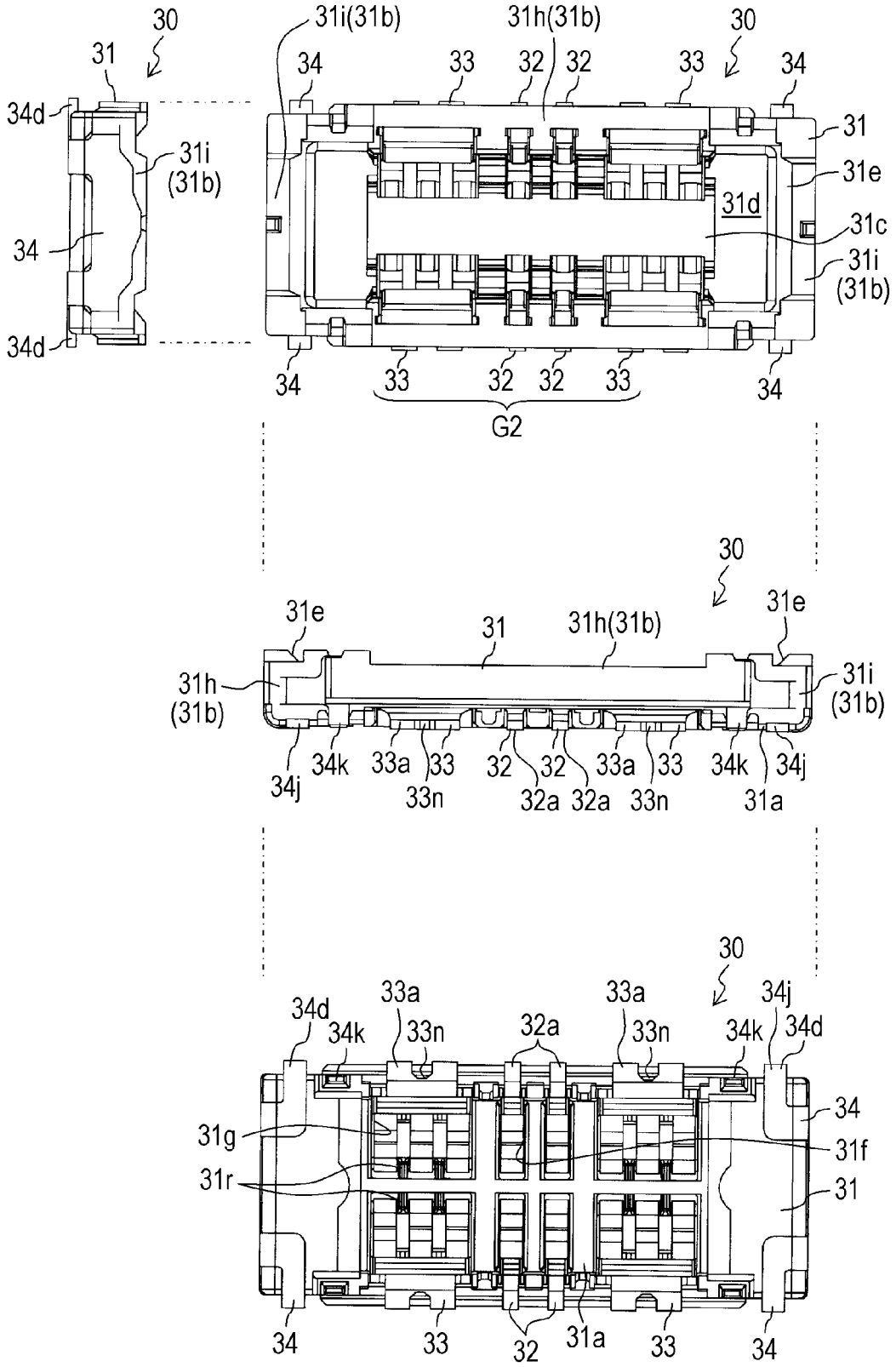
FIG. 17 illustrates the socket of the connector according to the embodiment of the present invention.

Next, a configuration of header housing 21 will be described with reference to FIGS. 4 to 6.

Header housing 21 has substantially a box shape opening to a single side (to the lower side of FIG. 5) and incudes plate wall 21*a* and circumferential wall 21*b* having substantially a rectangular frame shape continuously provided around plate wall 21*a*. Recess 21*c* (refer to FIG. 1) is formed in circumferential wall 21*b*. Tapered part 21*d* is provided at a lower end on an outer circumferential side of circumferential wall 21*b*. Tapered part 21*d* rises (toward plate wall 21*a*) as shifting outward. Tapered part 21*d* is provided at each of both ends of longitudinal direction wall 21*e* of circumferential wall 21*b* in the longitudinal direction and extends along respective one of lateral direction walls 21*f* of circumferential wall 21*b* entirely in width direction Y. In other words, Tapered parts 21*d* having substantially a U-shape are formed at both ends of header housing 21 in longitudinal direction X in a plan view (rear view) at lateral direction wall 21*f* and longitudinal direction wall 21*e* connected to both ends in the width direction Y of lateral direction wall 21*f*.

A portion of circumferential wall 21*b* between terminals adjacent to each other (between header-side signal terminal 22 and header-side power source terminal 23 which are adjacent to each other, and between header-side signal terminal 22 and header-side signal terminal 22 which are adjacent to each other) is rounded to have a reversed U-shape.

The length of lateral direction wall 21*f* in width direction Y is larger than a distance between two opposing longitudinal direction walls 21*e*. Header housing 21 has substantially an I-shape in a plan view as a whole.

Next, a configuration of header-side signal terminal 22 will be described with reference to FIGS. 7A to 7D, 8, 9A, and 9B.

Figure 29:
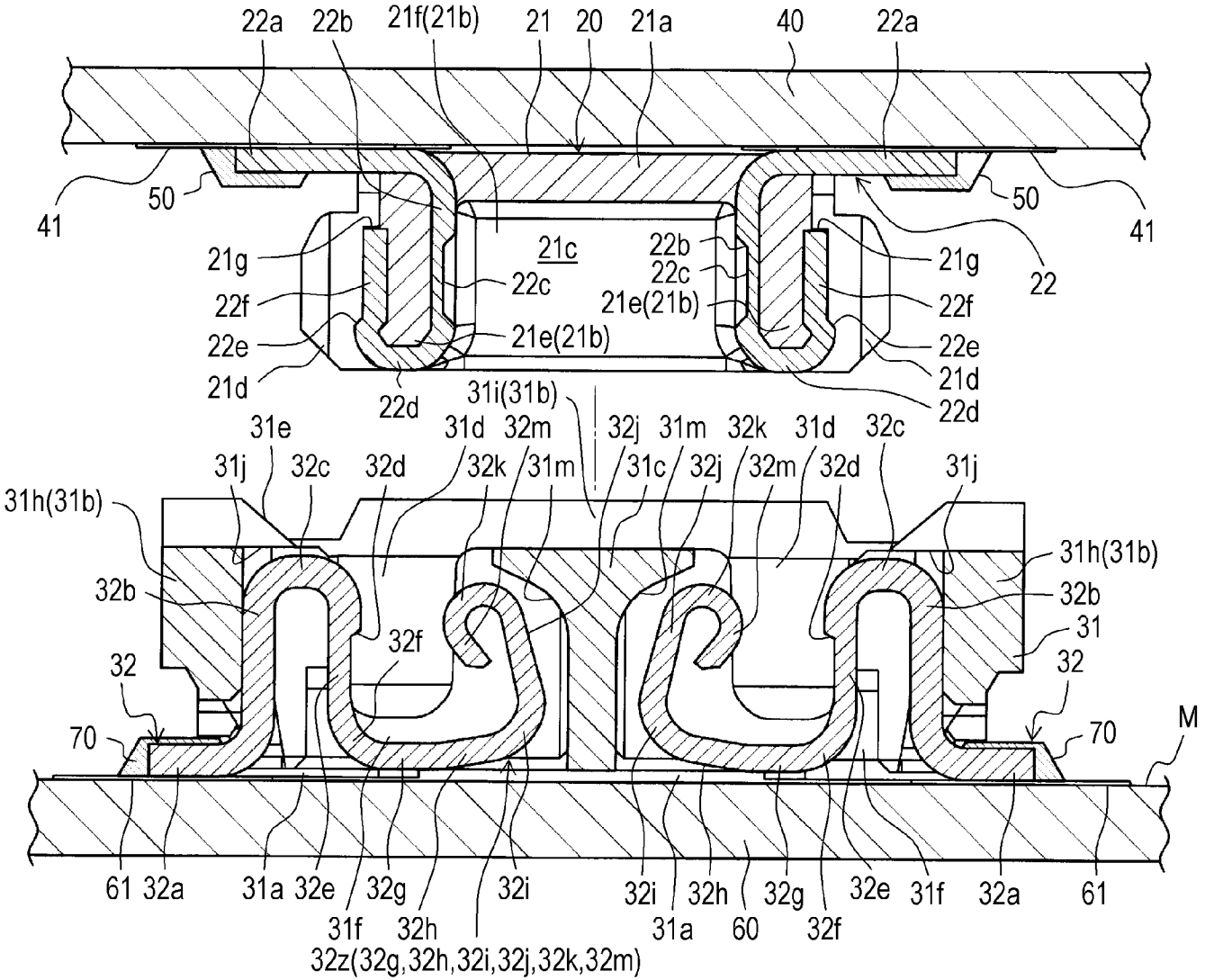
FIG. 29 is a sectional view of the connector according to the embodiment of the present invention at a part at which the header-side signal terminal and the socket-side signal terminal are disposed for illustrating a state immediately before the header and is engaged with a socket.

Header-side signal terminal 22 is manufactured by shaping metal to be conductive. Hader-side signal terminal 22 includes base part 22*a* which protrudes from a side surface of header housing 21. Base part 22*a* is configured to be fixed to circuit pattern 41 of second circuit board 40 with solder 50. As shown in FIG. 29, an upper surface of base part 22*a* extends substantially in parallel with an upper surface (an outer surface of plate wall 21*a*) of header housing 21.

Header-side signal terminal 22 includes inner part 22*b* connected to base part 22*a*. Inner part 22*b* passes through a joining part between plate wall 21*a* and longitudinal direction wall 21*e* of header housing 21 while bending, and extends to a tip end part of longitudinal direction wall 21*e* along the inner surface of longitudinal direction wall 21*e*.

Recess 22*c* is formed on the inner surface of inner part 22*b* of header-side signal terminal 22. In accordance with the embodiment, recess 22*c* has substantially a shape of a truncated rectangular pyramid shape by flat bottom surface 22*g*, inclined surface 22*h* connected to both sides of bottom surface 22*g* in longitudinal direction X, and inclined surface 22*i* connected to both sides of bottom surface 22*g* in upward-and-downward direction Z. Arcuate projection 32*k* of socket-side signal terminal 32 which will be described later is engaged with recess 22*c*.

Header-side signal terminal 22 includes tip end part 22*d* connected to one end of inner part 22*b*. Tip end part 22*d* is bent along a shape of the tip end of longitudinal direction wall 21*e* of header housing 21.

Header-side signal terminal 22 includes locked part 22*e* connected to tip end part 22*d*. In accordance with the embodiment, locked part 22*e* extends from one end to the other end of header-side signal terminal 22 in the longitudinal direction X of header housing 21. In other words, locked part 22*e* having a step is formed across the entire width of header-side signal terminal 22.

Figure 30:
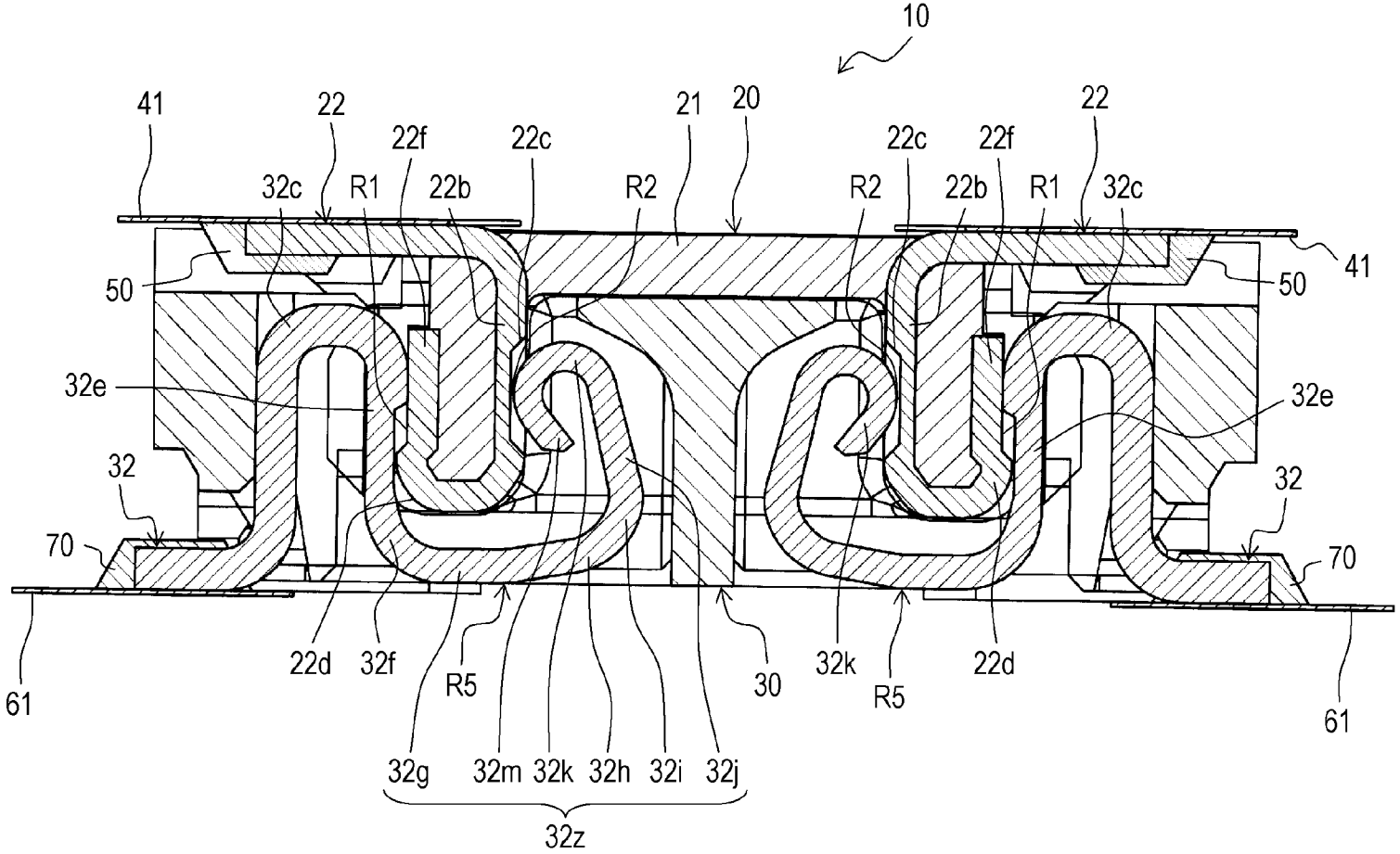
FIG. 30 is a sectional view of the connector according to the embodiment of the present invention at a part at which the header-side signal terminal and the socket-side signal terminal are disposed for illustrating a state where the header is engaged with the socket.

As shown in comparison of FIG. 29 with FIG. 30, locked part 22*e* is inserted more deeply than locking part 32*d* which serves as a step when header-side signal terminal 22 is engaged with socket-side signal terminal 32. Therefore, locked part 22*e* contacts locking part 32*d* when header-side signal terminal 22 is pulled out of socket-side signal terminal 32. In other words, locked part 22*e* of header-side signal terminal 22 is locked with locking part 32*d* of socket-side signal terminal 32. Therefore, header-side signal terminal 22 is prevented from being pulled out of socket-side signal terminal 32. In other words, header-side signal terminal 22 cannot be pulled out of socket-side signal terminal 32 only by applying an external force smaller than a predetermined value. Meanwhile, header-side signal terminal 22 can be pulled out of socket-side signal terminal 32 when a large external force equal to or larger than the predetermined value is applied. In other words, locked part 22*e* of header-side signal terminal 22 and locking part 32*d* of socket-side signal terminal 32 constitute a locking mechanism which can release the locked state by applying an external force equal to or larger than the predetermined value.

Locked part 22*e* may be manufactured by pressing a material of header-side signal terminal 22 to change the thickness of header-side signal terminal 22 partially, but the material of header-side signal terminal 22 may be manufactured by molding and bending the material in the thickness direction.

Header-side signal terminal 22 is connected to tip end part 22*d* via locked part 22*e*, and includes outer part 23*f* which extends along the outer surface of longitudinal direction wall 21*e*. In accordance with the embodiment, a tip end of outer part 23*f* of header-side signal terminal 22 is positioned by protrusion wall 21*g* which protrudes to the outer circumference of longitudinal direction wall 21*e* (circumferential wall 21*b*).

Header-side signal terminal 22 can be formed by molding and bending a metal material having a strip shape having a predetermined thickness.

In accordance with the embodiment, header-side signal terminal 22 is disposed in header housing 21 by insert molding. In addition, by pressing and engaging header-side signal terminal 22 with header housing 21, header-side signal terminal 22 may be disposed in header housing 21.

Next, a configuration of header-side power source terminal 23 will be described with reference to FIGS. 10A to 10D, 11, 12A, and 12B.

Figure 31:
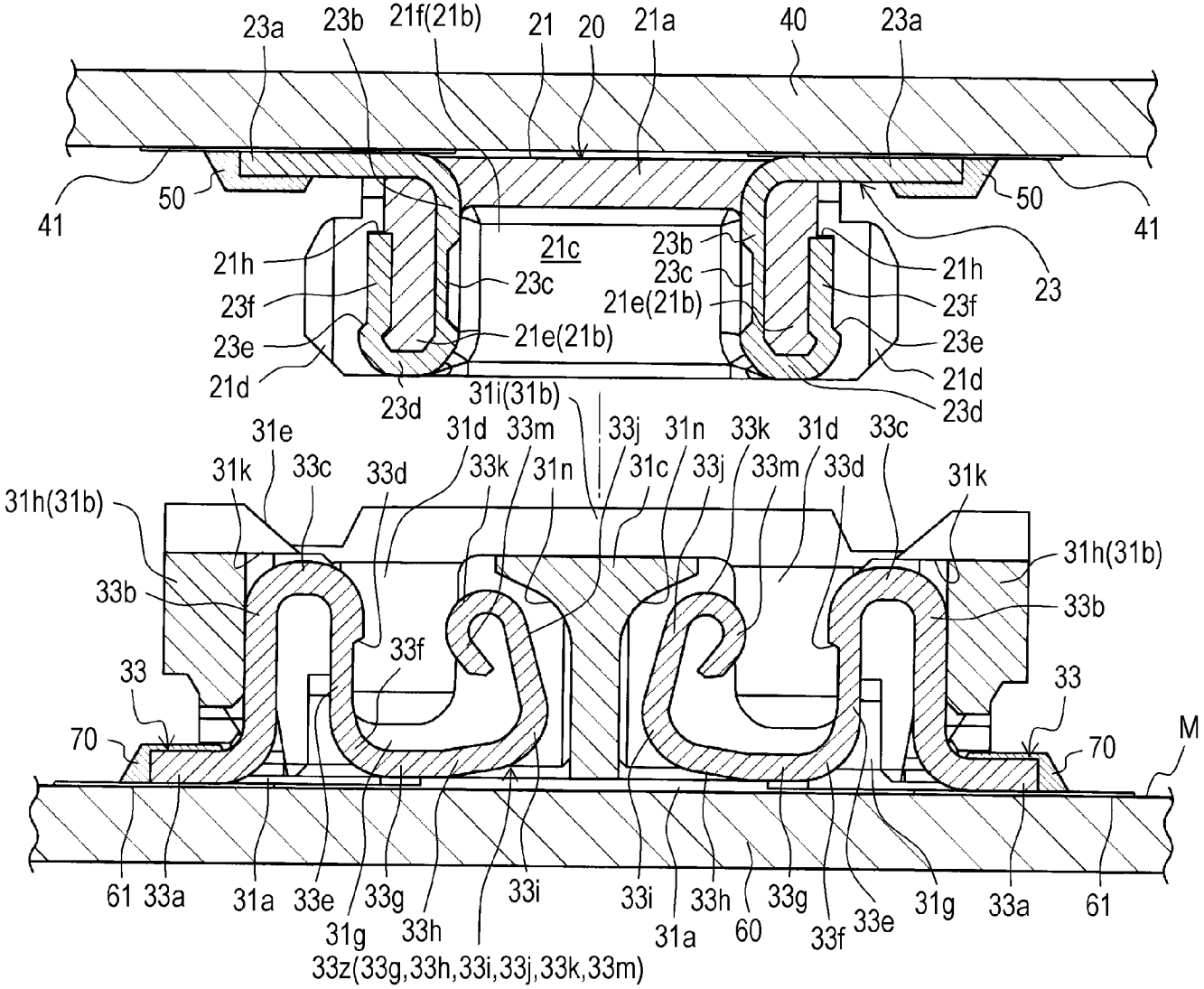
FIG. 31 is a sectional view of the connector according to the embodiment of the present invention at a part at which the header-side power source terminal and the socket-side power source terminal are disposed for illustrating a state immediately before the header is engaged with the socket.

Header-side power source terminal 23 is manufactured by shaping metal to be conductive. Header-side power source terminal 23 includes base part 23*a* which protrudes from the side surface of header housing 21. Base part 23*a* is configured to be fixed to circuit pattern 41 of second circuit board 40 with solder 50. As shown in FIG. 31, the upper surface of base part 23*a* extends substantially in parallel with the upper surface of header housing 21 (outer surface of plate wall 21*a*).

Header-side power source terminal 23 includes inner part 23*b* connected to base part 23*a*. Inner part 23*b* passes through a joining part between plate wall 21*a* and longitudinal direction wall 21*e* of header housing 21 while bending, and extends to the tip end part of longitudinal direction wall 21*e* along the inner surface of longitudinal direction wall 21*e*.

Recess 23*c* is formed in the inner surface of inner part 23*b* of header-side power source terminal 23. In accordance with the embodiment, recess 23*c* has substantially a truncated rectangular pyramid shape having flat bottom surface 23*g*, inclined surface 23*h* connected to both sides of bottom surface 23*g* in longitudinal direction X, and inclined surface 23*i* connected to both sides of bottom surface 23*g* in upward-and-downward direction Z. Arcuate projection 33*k* of socket-side power source terminal 33 which will be described later is engaged with recess 23*c*.

Header-side power source terminal 23 includes tip end part 23*d* connected to one end of inner part 23*b*. Tip end part 23*d* is bent along a shape of the tip end of longitudinal direction wall 21*e* of header housing 21.

Header-side power source terminal 23 includes locked part 23*e* connected to tip end part 23*d*. As shown in comparison of FIG. 31 with FIG. 32, locked part 23*e* is inserted more deeply than locking part 33*d* which serves as a step when header-side power source terminal 23 is engaged with socket-side power source terminal 33. Therefore, locked part 23*e* contacts locking part 33*d* when header-side power source terminal 23 is pulled out of socket-side power source terminal 33. In other words, locked part 23*e* of header-side power source terminal 23 is locked by locking part 33*d* of socket-side power source terminal 33. Therefore, header-side power source terminal 23 is prevented from being pulled out of socket-side power source terminal 33. In other words, header-side power source terminal 23 cannot be pulled out of socket-side power source terminal 33 only by applying an external force smaller than a predetermined value. Meanwhile, header-side power source terminal 23 can be pulled out of socket-side power source terminal 33 when a large external force equal to or greater than the predetermined value is applied. In other words, locked part 23*e* of header-side power source terminal 23 and locking part 33*d* of socket-side power source terminal 33 constitute a locking mechanism which can release the locked state by applying an external force equal to or greater than the predetermined value.

Locked part 23*e* may be manufactured by pressing a material of header-side power source terminal 23 to partially decrease the thickness of header-side power source terminal 23. The material of header-side power source terminal 23 may be manufactured by molding and bending the material in the thickness direction.

Header-side power source terminal 23 is continuous to tip end part 23*d* via locked part 23*e*, and is provided with outer side 23*f* which extends along the outer front surface of longitudinal direction wall 21*e*. Furthermore, in accordance with the embodiment, a tip end of outer side 23*f* of header-side power source terminal 23 is positioned by protrusion wall 21*h* which protrudes to the outer circumference of longitudinal direction wall 21*e* (circumferential wall 21*b*).

In accordance with the embodiment, the shape of the side section of header-side signal terminal 22 is substantially identical to the shape of the side section of header-side power source terminal 23 (refer to FIGS. 9A to 12A).

As described above, header-side signal terminal 22 and header-side power source terminal 23 are arranged in longitudinal direction X of header housing 21. In accordance with the embodiment, the width of header-side power source terminal 23 in longitudinal direction X of header housing 21 is larger than the width of header-side signal terminal 22 in longitudinal direction X.

In other words, in accordance with the embodiment, the width of header-side signal terminal 22 in longitudinal direction X of header housing 21 is smaller than that of header-side power source terminal 23 in longitudinal direction X. In accordance with the embodiment, the width of each header-side signal terminal 22 in longitudinal direction X of header housing 21 is smaller than that of header-side power source terminal 23 in longitudinal direction X.

Since the width of header-side power source terminal 23 in longitudinal direction X of header housing 21 is thus large, recess 23*j* formed in the center of base part 23*a* in longitudinal direction X. Recess 23*j* can increase the length of a border line contacting the circuit pattern of base part 23*a* while suppressing the increase in a protrusion amount of base part 23*a*. In addition, the recess provides the border line with a complicated border line. This configuration, compared to a terminal without recess 23*j*, increases the fixing strength between base part 23*a* and circuit pattern 41 with solder 50 when fixing wide header-side power source terminal 23 to circuit pattern 41 of second circuit board 40 with solder 50.

Three recesses 23*c* are formed in the inner surface of inner part 23*b* of header-side power source terminal 23 along the longitudinal direction X. Three arcuate projections 33*k* of socket-side power source terminal 33 which will be described later are engaged with the recesses.

Furthermore, in accordance with the embodiment, locked part 23*e* is formed from one end to the other end of header-side power source terminal 23 in the longitudinal direction X of header housing 21. In other words, locked part 23*e* having a step is formed across the entire width direction of wide header-side power source terminal 23. This configuration improves a locking force by locked part 23*e* of header-side power source terminal 23 and locking part 33*d* of socket-side power source terminal 33. Since the friction of locked part 23*e* is unlikely to occur due to repetitive insertion and removing of header 20 and socket 30, it is also possible to achieve a long service life of a product.

Header-side power source terminal 23 can be formed by performing molding and bending a metal material having a strip shape having a predetermined thickness.

In accordance with the embodiment, header-side power source terminal 23 is disposed in header housing 21 by the insert molding. In addition, by pressing and engaging header-side power source terminal 23 with header housing 21, header-side power source terminal 23 may be disposed in header housing 21.

Next, a configuration of header-side holder bracket 24 will be described with reference to FIGS. 13A to 13D, and 14.

Header-side holder bracket 24 is manufactured by shaping metal similarly to header-side signal terminal 22 and header-side power source terminal 23.

Header-side holder bracket 24 includes mounting terminal 24*a* which protrudes from the side surface of header housing 21. Mounting terminal 24*a* is configured to be fixed to circuit pattern 41 of second circuit board 40 with solder 50. In addition, the upper surface of mounting terminal 24*a* extends substantially in parallel with the upper surface of header housing 21 (outer front surface of plate wall 21*a*).

Header-side holder bracket 24 includes inner part 24*b* connected to mounting terminal 24*a*. Cut out 24*c* which is open to one side of inner part 24*b* in the longitudinal direction X is formed in inner part 24*b*. Cut out 24*c* formed in inner part 24*b* can cause header housing 21 to adhere to header-side holder bracket 24 tightly, and increases the strength of header housing 21.

In accordance with the embodiment, header-side holder bracket 24 is disposed in header housing 21 by insert molding. By pressing and engaging header-side holder bracket 24 with header housing 21, header-side holder bracket 24 may be disposed in header housing 21.

Next, a configuration of socket 30 of connector 10 will be described with reference to FIGS. 15 to 28.

Socket 30 includes socket housing 31 as described above. In accordance with the embodiment, socket housing 31 has a rectangular oblong shape as a whole in a plan view and is made of insulating synthetic resin (refer to FIGS. 15 to 20).

Socket-side signal terminal 32 made of metal and socket-side power source terminal 33 made of metal are disposed in socket housing 31.

Socket-side signal terminal 32 is configured to be electrically connected to a signal line to transmit a signal. Meanwhile, socket-side power source terminal 33 is configured to be electrically connected to a power source line to supply power.

In accordance with the embodiment, two socket-side signal terminals 32 and two socket-side power source terminals 33 separated from each other are arranged along one long side of socket housing 31. Two socket-side signal terminals 32 and two socket-side power source terminals 33 which are disposed at one side of socket housing 31 in width direction X (the lateral direction) of socket housing 31 constitute socket-side terminal group G2.

Two socket-side signal terminals 32 and two socket-side power source terminals 33 separated from each other are arranged along the other long side of socket housing 31. Two socket-side signal terminals 32 and two socket-side power source terminals 33 which are disposed at the other side in width direction X (the lateral direction) of socket housing 31 constitute another socket-side terminal group G2.

In accordance with the embodiment, in socket housing 31, two rows (plural rows) of socket-side terminal groups G2 each including socket-side signal terminal 32 and socket-side power source terminal 33 arranged along longitudinal direction X of socket housing 31 are disposed.

In the first row of socket-side terminal group G2, socket-side power source terminals 33 are disposed at both ends of socket-side signal terminal 32. In other words, socket-side power source terminals 33 are disposed at both ends of socket housing 31 in the longitudinal direction X, and two socket-side signal terminals 32 are disposed between socket-side power source terminals 33. In accordance with the embodiment, socket-side power source terminal 33 is disposed more outside in longitudinal direction X of socket housing 31 than socket-side signal terminal 32.

Socket-side signal terminal 32 and socket-side power source terminal 33 are disposed in socket housing 31 to contact header-side signal terminal 22 and header-side power source terminal 23, respectively, when header 20 is engaged with socket 30.

In accordance with the embodiment, socket-side holder brackets 34 made of metal are disposed at both ends in the longitudinal direction X of socket housing 31. Socket-side holder brackets 34 increases the strength of socket housing 31, and is configured to fix mounting terminal 34*d* provided in socket-side holder brackets 34 to first circuit board 60, as described above.

Next, a configuration of socket housing 31 will be described with reference to FIGS. 18 to 20.

Socket housing 31 has substantially a box shape opening to a single side (upper side of FIG. 15) and includes plate wall 31*a* and circumferential wall 31*b* having a rectangular frame shape passing through circumferential edges of plate wall 31*a*. In accordance with the embodiment, island 31*c* having substantially a rectangular shape apart from circumferential wall 31*b* by a predetermined interval is provided at the center of plate wall 31*a*. Engaging groove 31*d* to be engaged with circumferential wall 21*b* of header 20 is formed between circumferential wall 31*b* and island 31*c*. Island 31*c* is engaged with recess 21*c*.

Since lateral direction wall 21*f* and longitudinal direction wall 21*e* are engaged with engaging groove 31*d*, engaging groove 31*d* has a width larger partially at both end parts thereof in longitudinal direction Y.

In accordance with the embodiment, tapered part 31*e* is provided at an upper end on an inner circumferential side of circumferential wall 31*b* to be positioned at a lower position (toward plate wall 31*a*) as shifting toward inside. Tapered parts 31*e* are formed at both ends of longitudinal direction wall 31*h* in the longitudinal direction of longitudinal direction wall 31*h* of circumferential wall 31*b* and at lateral direction wall 31*i* of circumferential wall 31*b*. Tapered part 31*e* is formed in circumferential wall 31*b* between socket-side signal terminal 32 and socket-side power source terminal 33 which are adjacent to each other. In accordance with the embodiment, tapered part 31*e* is formed across substantially the entire circumference of circumferential wall 31*b*.

Figure 18:
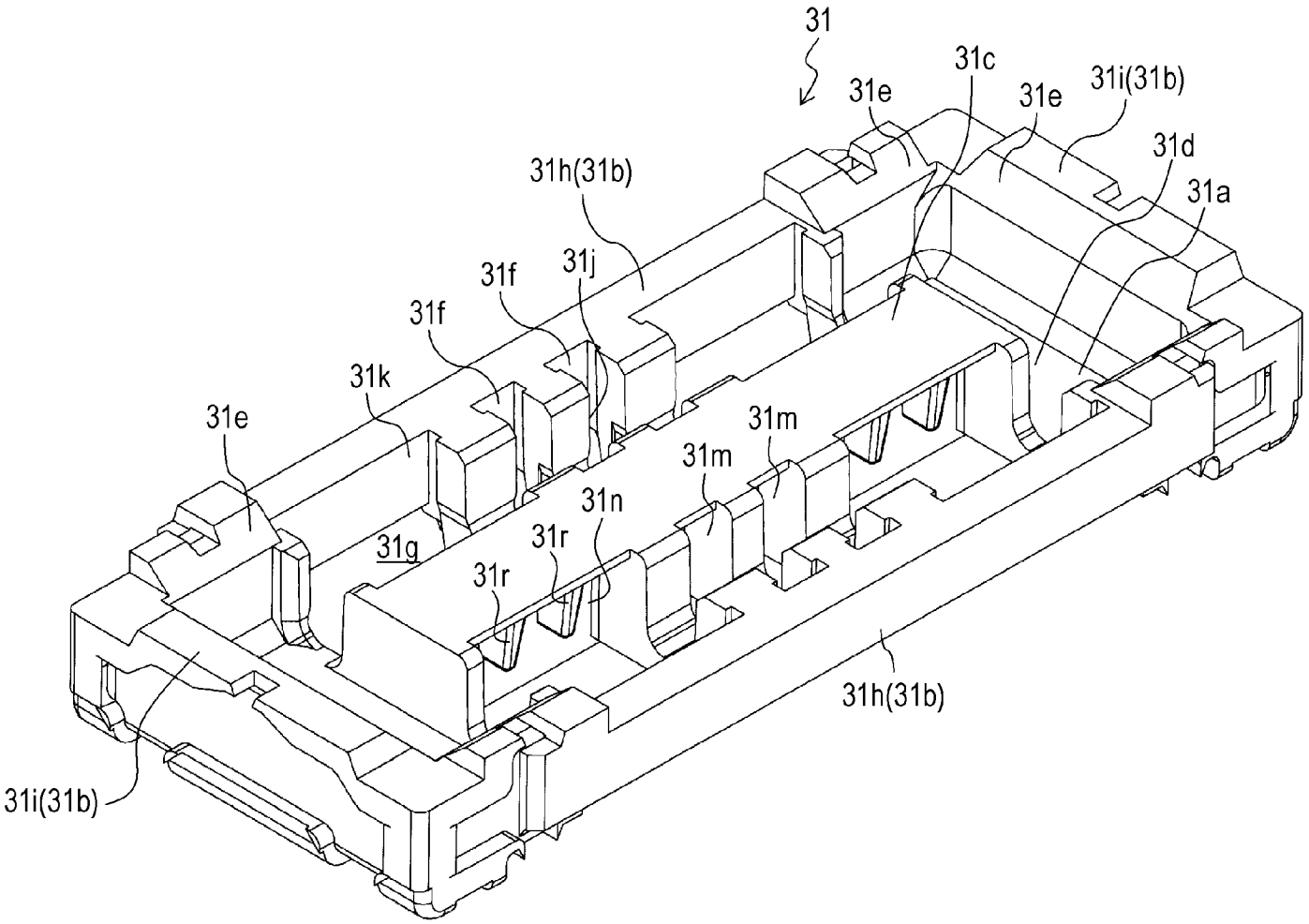
FIG. 18 is a perspective view of a socket housing of the connector according to the embodiment of the present invention viewing from the front surface side.
Figure 19:
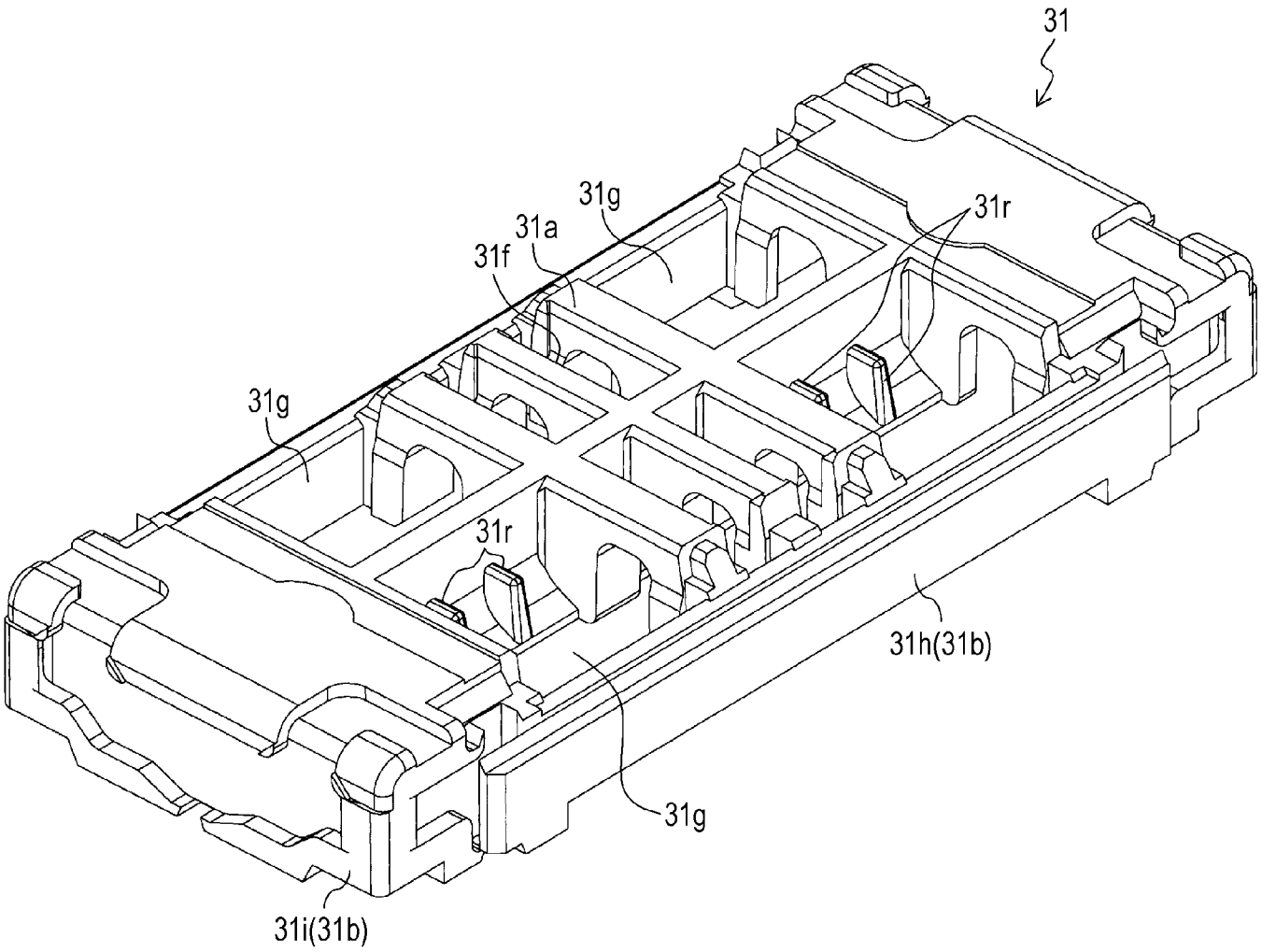
FIG. 19 is a perspective view of the socket housing of the connector according to the embodiment of the present invention viewing from the rear surface side.
Figure 20:
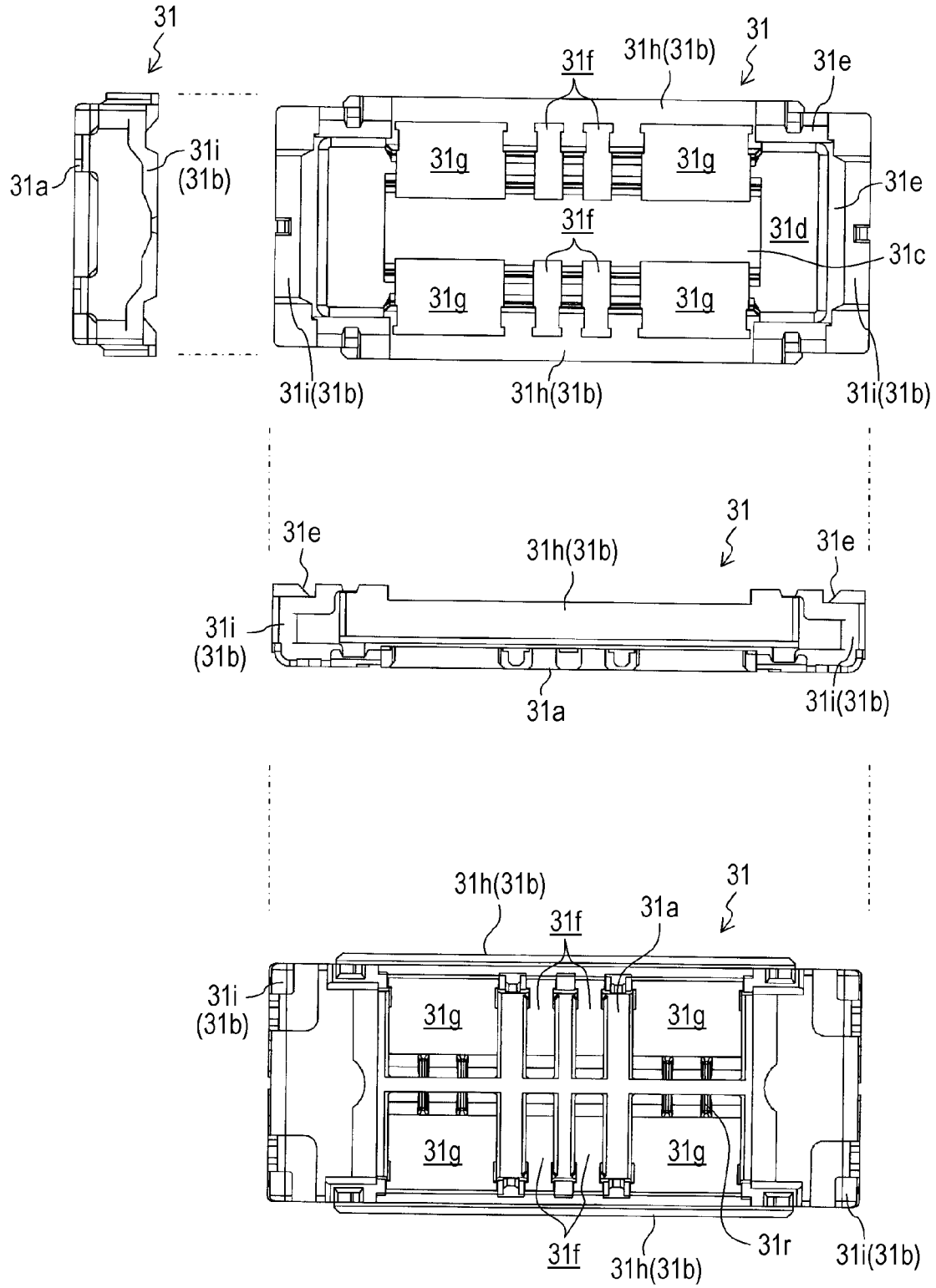
FIG. 20 illustrates the socket housing of the connector according to the embodiment of the present invention.
Figure 21A:
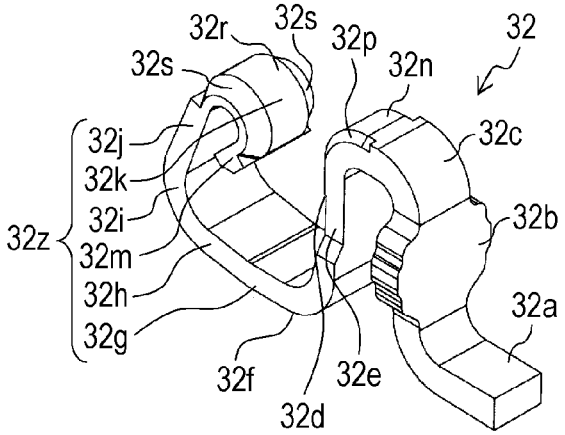
FIG. 21A is a first perspective view of a socket-side signal terminal of the connector according to the embodiment of the present invention.
Figure 21B:
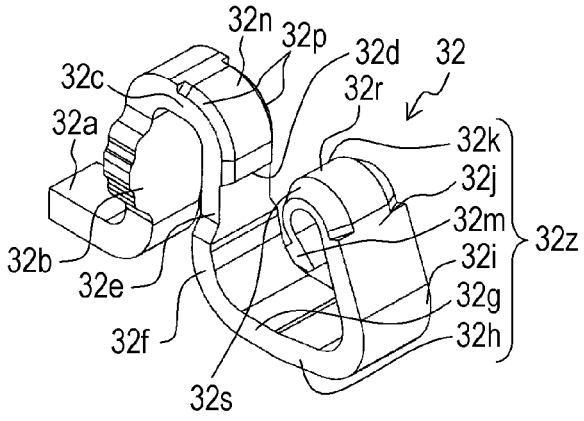
FIG. 21B is a second perspective view of the socket-side signal terminal of the connector according to the embodiment of the present invention.
Figure 21C:
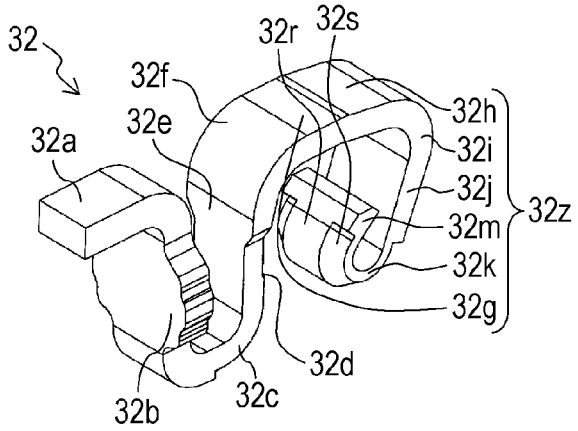
FIG. 21C is a third perspective view of the socket-side signal terminal of the connector according to the embodiment of the present invention.
Figure 21D:
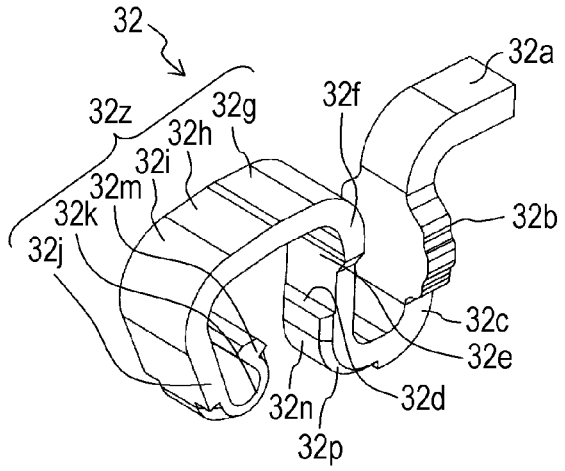
FIG. 21D is a fourth perspective view of the socket-side signal terminal of the connector according to the embodiment of the present invention.
Figure 22:
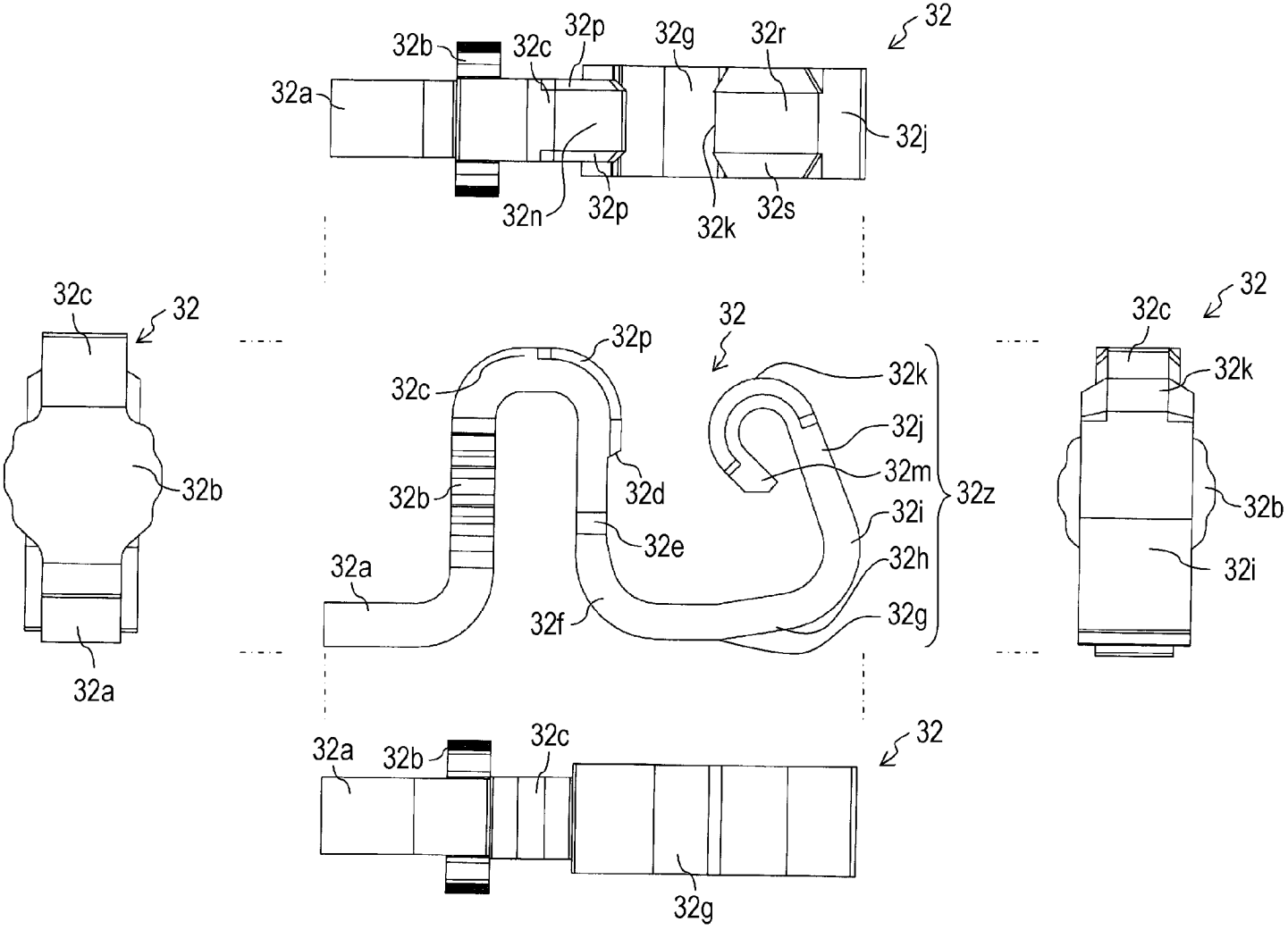
FIG. 22 illustrates the socket-side signal terminal of the connector according to the embodiment of the present invention.

In accordance with the embodiment, in socket housing 31, socket-side signal terminal accommodator 31*f* in which socket-side signal terminal 32 is accommodated is formed to pass through plate wall 31*a* (refer to FIGS. 18 to 20). In addition, in socket housing 31, socket-side power source terminal accommodator 31*g* in which socket-side power source terminal 33 is accommodated is formed to penetrate plate wall 31*a*.

Socket-side signal terminal accommodator 31*f* includes socket-side signal terminal accommodation recess 31*j* communicating with engaging groove 31*d* formed in longitudinal direction wall 31*h*, and socket-side signal terminal accommodation recess 31*m* communicating with engaging groove 31*d* formed in island 31*c*.

Socket-side power source terminal accommodator 31*g* includes socket-side power source terminal accommodation recess 31*k* communicating with engaging groove 31*d* formed in longitudinal direction wall 31*h*, and socket-side power source terminal accommodation recess 31*n* communicating with engaging groove 31*d* formed in island 31*c*.

Socket-side signal terminal 32 and socket-side power source terminal 33 are pressed and engaged with socket-side signal terminal accommodator 31*f* and socket-side power source terminal accommodator 31*g* from the rear side of socket housing 31, respectively.

Next, a configuration of socket-side signal terminal 32 will be described with reference to FIGS. 21A to 21D, 22, 23A, and 23B.

Socket-side signal terminal 32 is manufactured by shaping metal to be conductive. Socket-side signal terminal 32 includes base part 32*a* which protrudes from the side surface of socket housing 31. Base part 32*a* is configured to be fixed to circuit pattern 61 of first circuit board 60 with solder 70. A lower surface of base part 32*a* extends along a main surface M of first circuit board 60, and is flush with a bottom surface of socket housing 31 (rear surface of plate wall 31*a*).

Socket-side signal terminal 32 includes rising part 32*b* which rises from base part 32*a* and extends to be separated from first circuit board 60. Rising part 32*b* enters socket-side signal terminal accommodation recess 31*j* being bent from base part 32*a*, and extends along the inner surface of longitudinal direction wall 31*h*.

Socket-side signal terminal 32 includes reversed U-shaped part 32*c* having one end connected to the upper end of rising part 32*b*. Reversed U-shaped part 32*c* has a shape of a letter "U" reversed upside down. Reversed U-shaped part 32*c* has tip end surface 32*n* and inclined surface 32*p* connected to both sides of tip end surface 32*n* in the longitudinal direction X, and protrudes to have substantially a trapezoidal shape in a lateral sectional view of reversed U-shaped part 32*c* (refer to FIG. 23B).

Socket-side signal terminal 32 includes locking part 32*d* connected to the other end of reversed U-shaped part 32*c*. In accordance with the embodiment, locking part 32*d* extends from one end to the other end of socket-side signal terminal 32 in the longitudinal direction X of socket housing 31. In other words, locking part 32*d* having a step extends across the entire width direction of socket-side signal terminal 32.

As described above, locking part 32*d* suppresses movement of locked part 22*e* when header-side signal terminal 22 is pulled out of socket-side signal terminal 32. In other words, locking part 32*d* of socket-side signal terminal 32 can contact locked part 22*e* of header-side signal terminal 22, and can lock locked part 22*e*. Locking part 32*d* and socket-side signal terminal 32 and locked part 22*e* of header-side signal terminal 22 constitute a locking mechanism which can release the locked state by applying an external force equal to or greater than the predetermined value.

Locking part 32*d* may be manufactured by pressing a material of socket-side signal terminal 32 to partially decrease the thickness of the material. Socket-side signal terminal 32 may be manufactured by shaping and bending the material in the thickness direction of socket-side signal terminal 32.

Socket-side signal terminal 32 includes falling part 32*e* connected to locking part 32*d* and extending substantially in parallel with rising part 32*b*. Socket-side signal terminal 32 includes first arcuate part 32*f* connected to the lower end of falling part 32*e*.

As illustrated in FIGS. 29 and 30, socket-side signal terminal 32 includes opposing part 32*z* connected to first arcuate part 32*f*. Opposing part 32*z* includes flat part 32*g* which will be described next, first inclination 32*h*, second arcuate part 32*i*, second inclination 32*j*, arcuate projection 32*k*, and tip end part 32*m*. Opposing part 32*z* will be described below.

Opposing part 32*z* includes flat part 32*g* connected to the lower end of arcuate part 32*f*. As illustrated in FIG. 29, flat part 32*g* extends along main surface M of first circuit board 60 to be separated from falling part 32*e*. However, flat part 32*g* is not necessarily parallel with main surface M. Flat part 32*g* is provided to increase a spring length of a spring which will be described later.

As illustrated in FIG. 29, opposing part 32*z* includes first inclination 32*h* connected to flat part 32*g* and extends in a direction inclining with respect to main surface M of first circuit board 60. First inclination 32*h* extends to be separated from falling part 32*e* as being separated from first circuit board 60. First inclination 32*h* is connected to second arcuate part 32*i*. Second arcuate part 32*i* is a curve which protrudes to be separated from falling part 32*e*. Second arcuate part 32*i* is connected to second inclination 32*j* which extends in a direction inclining with respect to main surface M of first circuit board 60. Second inclination 32*j* extends to approach falling part 32*e* as being separated from first circuit board 60. Therefore, second inclination 32*j* is positioned above first inclination 32*h*.

As illustrated in FIG. 29, opposing part 32*z* includes arcuate projection 32*k* having one end connected to the upper end of second inclination 32*j*. Arcuate projection 32*k* has tip end surface 32*r* and inclined surfaces 32*s* connected to both sides of tip end surface 32*r* in longitudinal direction X, and protrudes substantially a trapezoidal shape in a lateral sectional view (refer to FIG. 26B).

As illustrated in FIG. 29, arcuate projection 32*k* is engaged with recess 22*c* in header-side signal terminal 22. The other end of arcuate projection 32*k* is connected to tip end part 32*m*. Tip end part 32*m* extends substantially in parallel to second inclination 32*j*. As shown in FIGS. 29 and 30, opposing part 32*z* (32*g*, 32*h*, 32*i*, 32*j*, 32*k*, 32*m*) is connected to the lower end of arcuate part 32*f*, and faces falling part 32*e* as a whole.

In accordance with the embodiment, when header 20 is engaged with socket 30, as illustrated in FIG. 30, header-side signal terminal 22 is inserted into between reversed U-shaped part 32*c* and arcuate projection 32*k*. At this moment, falling part 32*e*, arcuate part 32*f*, flat part 32*g*, first inclination 32*h*, arcuate part 32*i*, second inclination 32*j*, arcuate projection 32*k*, and tip end part 32*m* function as the spring as a whole. The spring (32*e*, 32*f*, 32*g*, 32*h*, 32*i*, 32*j*, 32*k*, and 32*m*) elastically deforms when the projection of header-side signal terminal 22 is inserted into the recess formed in socket-side signal terminal 32. Accordingly, the distance between arcuate projection 32*k* and each of falling part 32*e* and reversed U-shaped part 32*c* increases. At this moment, locked part 22*e* of header-side signal terminal 22 is inserted more deeply than locking part 32*d* of socket-side signal terminal 32. Accordingly, arcuate projection 32*k* of socket-side signal terminal 32 is engaged with recess 22*c* of header-side signal terminal 22.

While header-side signal terminal 22 is engaged with socket-side signal terminal 32, the spring elastically deforming generates a restoring force. The restoring force causes arcuate projection 32*k* to press header-side signal terminal 22 to each of falling part 32*e* and reversed U-shaped part 32*c*. Accordingly, header-side signal terminal 22 is nipped by socket-side signal terminal 32. At this moment, header-side signal terminal 22 contacts each of reversed U-shaped part 32*c*, falling part 32*e*, and arcuate projection 32*k* of socket-side signal terminal 32.

Specifically, as illustrated in FIGS. 29 to 33A, and 33B, tip end part 22*d* of header-side signal terminal 22 contacts falling part 32*e* of socket-side signal terminal 32. In other words, contact portion R1 of socket-side signal terminal 32 contacts contact portion R1 of header-side signal terminal 22.

Recess 22*c* in header-side signal terminal 22 contacts arcuate projection 32*k* of socket-side signal terminal 32. In other words, contact portion R2 of socket-side signal terminal 32 contacts contact portion R2 of header-side signal terminal 22.

Header-side signal terminal 22 thus contacts socket-side signal terminal 32 at plural contact portions (contact portion R1 and contact portion R2) which are separated from each other in the width direction Y. This configuration increases reliability of electrical connection between header-side signal terminal 22 and socket-side signal terminal 32.

In accordance with the embodiment, recess 22*c* is formed at contact portion R2 of header-side signal terminal 22 which is one contact point of contact portion R2 of socket-side signal terminal 32 and contact portion R2 of header-side signal terminal 22 which contact each other. Contact portion R2 of socket-side signal terminal 32 which is the other contact point of contact portions R2 contacts both end parts of recess 22*c* in the longitudinal direction X of socket housing 31.

Figure 33A:
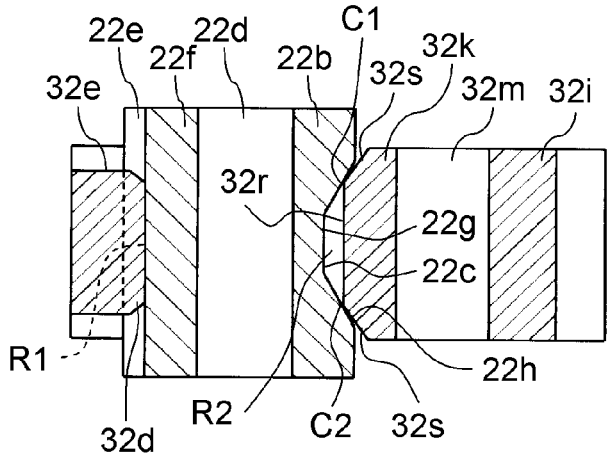
FIG. 33A is a lateral sectional view of the connector according to the embodiment of the present invention for schematically illustrating a contact state between the terminals and a contact state between the header-side signal terminal and the socket-side signal terminal.

Specifically, as illustrated in FIG. 33A, when arcuate projection 32*k* of socket-side signal terminal 32 is engaged with recess 22*c*, the boundary part between tip end surface 32*r* of arcuate projection 32*k* and inclined surface 32*s* contacts inclined surface 22*h*. In accordance with the embodiment, contact portion R2 of socket-side signal terminal 32 contacts contact portion R2 of header-side signal terminal 22 two points (contact point C1 and contact point C2).

The elastic deformation of the spring, except for contact portions R1 and R2, may cause a boundary part between flat part 32*g* and first inclination 32*h* to contact first circuit board 60 not only at contact portions R1 and R2 but also at contact portion R5.

Header-side signal terminal 22 thus contacts socket-side signal terminal 32 of accordance with the embodiment at plural contact points separated from each other in the width direction Y. The header-side signal terminal may contact the socket-side signal terminal of the present invention, for example, only at one contact point between the inner surface of the header-side signal terminal and an opposing part of the socket-side signal terminal.

Figure 23A:
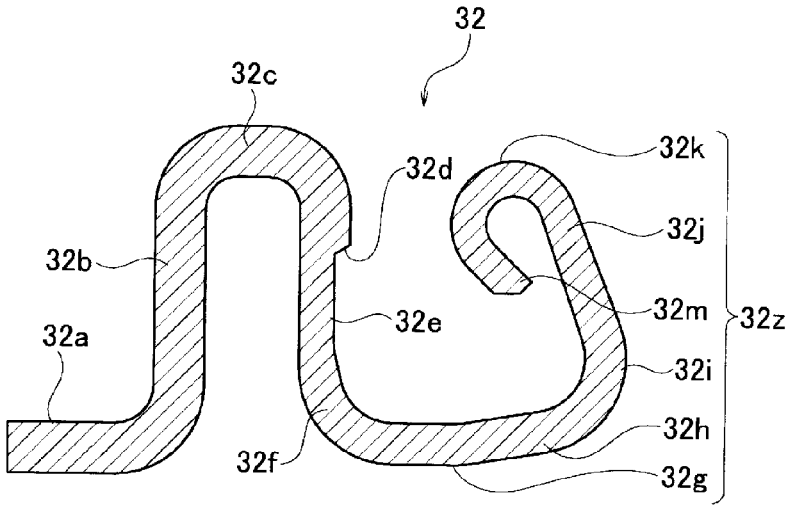
FIG. 23A is a side sectional view of the socket-side signal terminal of the connector according to the embodiment of the present invention.
Figure 23B:
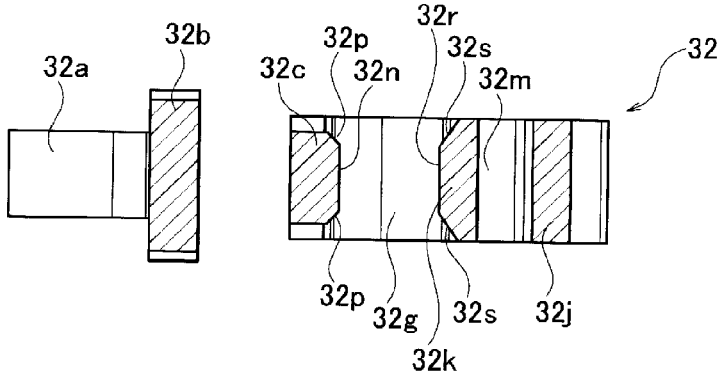
FIG. 23B is a lateral sectional view of the socket-side signal terminal of the connector according to the embodiment of the present invention.
Figure 24A:
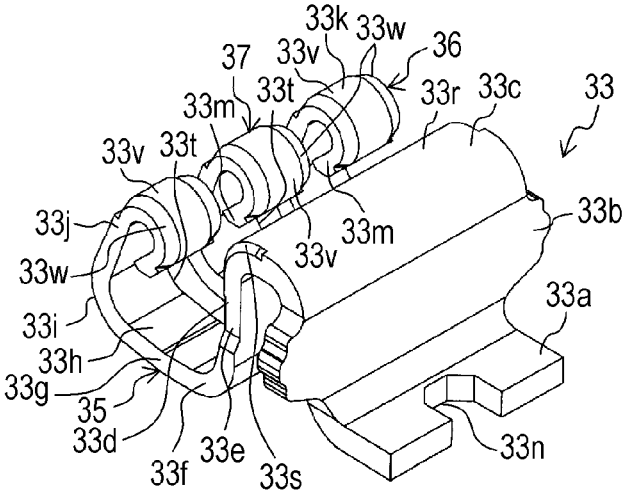
FIG. 24A is a first perspective view of a socket-side power source terminal of the connector according to the embodiment of the present invention.
Figure 24B:
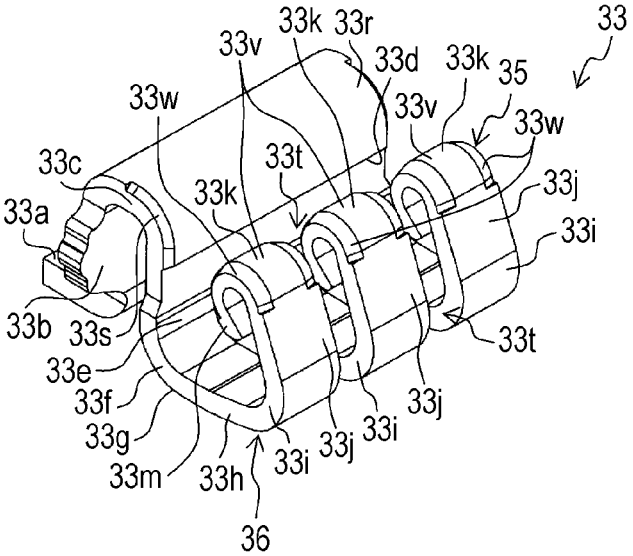
FIG. 24B is a second perspective view of the socket-side power source terminal of the connector according to the embodiment of the present invention.
Figure 24C:
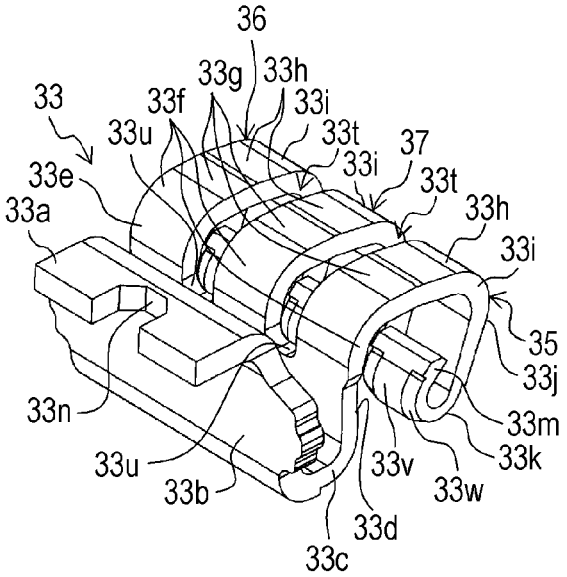
FIG. 24C is a third perspective view of the socket-side power source terminal of the connector according to the embodiment of the present invention.
Figure 24D:
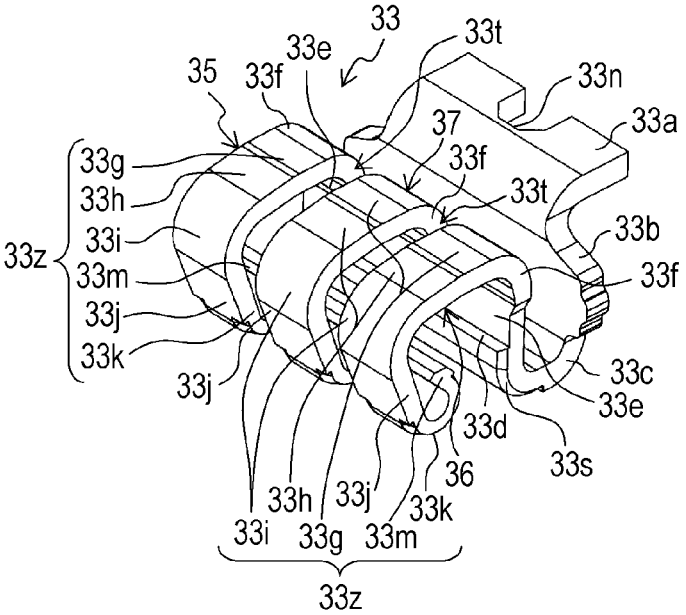
FIG. 24D is a fourth perspective view of the socket-side power source terminal of the connector according to the embodiment of the present invention.
Figure 25:
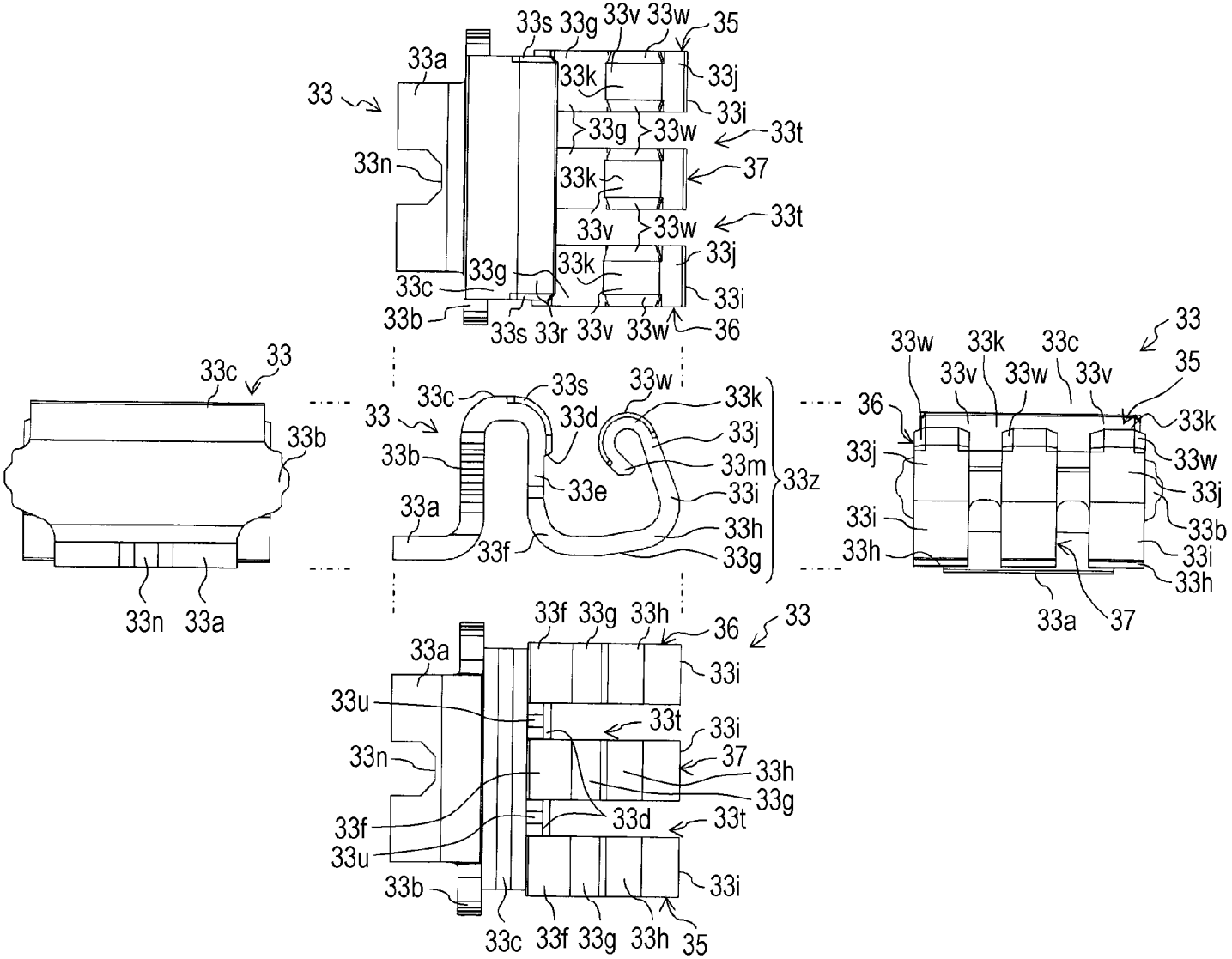
FIG. 25 illustrates the socket-side power source terminal of the connector according to the embodiment of the present invention.

As shown in FIG. 23A, the spring (32*e*, 32*f*, 32*g*, 32*h*, 32*i*, 32*j*, 32*k*, 32*m*) includes the U-shaped part (32*e*, 32*f*, 32*g*, 32*h*, 32*i*, and 32*j*) and a free end (32*k* and 32*m*) which is connected to one end (32*j* side) of the U-shaped part (32*e*, 32*f*, 32*g*, 32*h*, 32*i*, and 32*j*). Contact portion R2 of socket-side signal terminal 32 is provided in arcuate projection 32*k* of the free end (32*k* and 32*m*).

Socket-side signal terminal 32 thus has the U-shaped part (32*e*, 32*f*, 32*g*, 32*h*, 32*i*, and 32*j*), and the free end (32*k* and 32*m*) having contact portion R2 is connected to one end (32*j* side) of the U-shaped part (32*e*, 32*f*, 32*g*, 32*h*, 32*i*, and 32*j*).

Socket-side signal terminal 32 can be formed by shaping and bending a metal material having a strip shape having a predetermined thickness.

Socket-side signal terminal 32 is mounted onto socket housing 31 by pressing and inserting socket 30 to socket-side signal terminal accommodator 31*f* from the rear side (the lower side of FIG. 15) of socket housing 31 when assembling socket 30.

Socket-side signal terminal 32 may be mounted onto socket housing 31 by, e.g. performing the insert molding with respect to socket-side signal terminal 32 in socket housing 31, or the like.

Next, a configuration of socket-side power source terminal 33 will be described with reference to FIGS. 24A to 24D, 25, 26A, and 26B.

Socket-side power source terminal 33 is manufactured by shaping metal to be conductive. Socket-side power source terminal 33 includes base part 33*a* which protrudes from the side surface of socket housing 31. Base part 33*a* is configured to be fixed to circuit pattern 61 of first circuit board 60 with solder 70. A lower surface of base part 33*a* extends along a main surface M of first circuit board 60, and is flush with the bottom surface of socket housing 31 (a rear surface of plate wall 31*a*).

Socket-side power source terminal 33 includes rising part 33*b* which rises from base part 33*a* and extends to be separated from first circuit board 60. Rising part 33*b* enters into socket-side power source terminal accommodation recess 31*k* being bent from base part 33*a*, and extends along the inner surface of longitudinal direction wall 31*h*.

Socket-side power source terminal 33 includes reversed U-shaped part 33*c* having one end connected to the upper end of rising part 33*b*. Reversed U-shaped part 33*c* has a shape of a letter "U" reversed upside down. Reversed U-shaped part 33*c* has tip end surface 33*r* and inclined surface 33*s* connected to both sides of tip end surface 33*r* in the longitudinal direction X, and protrudes to have a cross section having substantially a trapezoidal shape in a lateral sectional view (refer to FIG. 26B).

Socket-side power source terminal 33 includes locking part 33*d* connected to the other end of reversed U-shaped part 33*c*. As described above, locking part 33*d* suppresses movement of locked part 23*e* when header-side power source terminal 23 is pulled out of socket-side power source terminal 33. In other words, locking part 33*d* of socket-side power source terminal 33 can contacts locked part 23*e* of header-side power source terminal 23, and can lock locked part 23*e*. Locking part 33*d*, socket-side power source terminal 33, and locked part 23*e* of header-side power source terminal 23 constitute a locking mechanism which can release the locked state by applying an external force equal to or greater than the predetermined value.

Locking part 33*d* may be manufactured by pressing a material of socket-side power source terminal 33 to partially change the thickness of socket-side power source terminal 33, but the material of socket-side power source terminal 33 may be manufactured by performing the molding and bending of the material in the thickness direction.

Socket-side power source terminal 33 includes falling part 33*e* connected to locking part 33*d* and extends substantially in parallel with rising part 33*b*.

Socket-side power source terminal 33 includes first arcuate part 33*f* connected to the lower end of falling part 33*e*.

Figure 32:
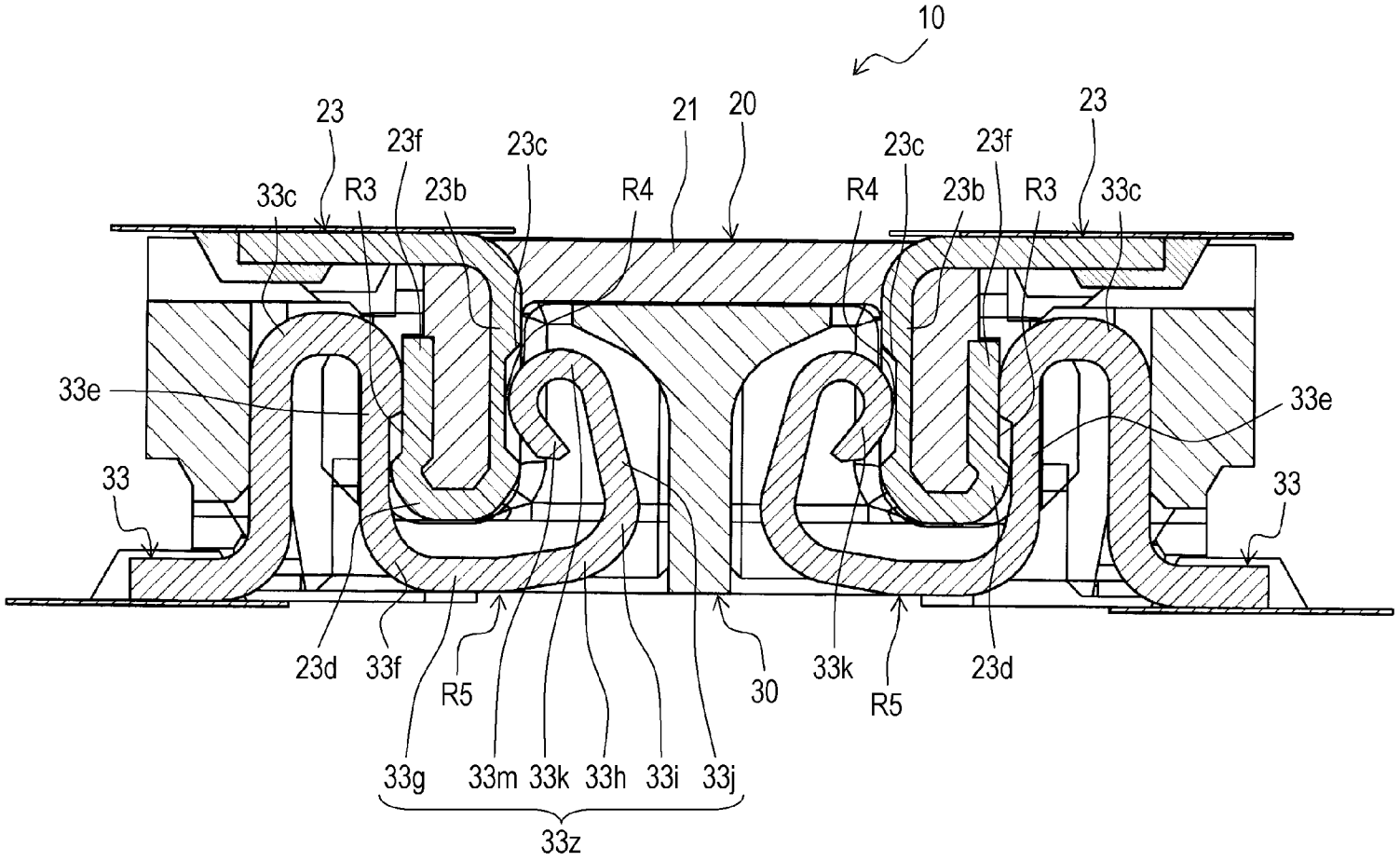
FIG. 32 is a sectional view of the connector according to the embodiment of the present invention at a part at which the header-side power source terminal and the socket-side power source terminal are disposed for illustrating a state where the header is engaged with the socket.

As illustrated in FIGS. 31 and 32, socket-side power source terminal 33 includes opposing part 33*z* connected to first arcuate part 33*f*. Opposing part 33*z* includes flat part 33*g* which will be described later, first inclination 33*h*, second arcuate part 33*i*, second inclination 33*j*, arcuate projection 33*k*, and tip end part 33*m*. Opposing part 33*z* will be described below.

Opposing part 33*z* includes flat part 33*g* connected to the lower end of arcuate part 33*f*. As illustrated in FIG. 31, flat part 33*g* extends along main surface M of first circuit board 60 to be separated from falling part 33*e*. However, flat part 33*g* is not necessarily in parallel with main surface M. Flat part 33*g* increases a spring length of a spring which will be described later.

As illustrated in FIG. 31, opposing part 33*z* includes first inclination 33*h* connected to flat part 33*g* and extends in a direction inclining with respect to main surface M of first circuit board 60. First inclination 33*h* extends to be separated from falling part 33*e* as being separated from first circuit board 60. First inclination 33*h* is connected to second arcuate part 33*i*. Second arcuate part 33*i* has a curve which protrudes to be separated from falling part 33*e*. Second arcuate part 33*i* is connected to second inclination 33*j* which extends in a direction inclining with respect to main surface M of first circuit board 60. Second inclination 33*j* extends to approach falling part 33*e* as being separated from first circuit board 60. Therefore, second inclination 33*j* is positioned above first inclination 33*h*.

As illustrated in FIG. 31, opposing part 33*z* includes arcuate projection 33*k* having one end connected to the upper end of second inclination 33*j*. Arcuate projection 33*k* has tip end surface 33*v* and inclined surface 33*w* which is connected to both sides of tip end surface 33*v* in the longitudinal direction X, and protrudes to have substantially a trapezoidal shape in a lateral sectional view (refer to FIG. 26B).

As illustrated in FIG. 31, arcuate projection 33*k* is engaged with recess 23*c* of header-side power source terminal 23. The other end of arcuate projection 33*k* is connected to tip end part 33*m*. Tip end part 33*m* extends substantially in parallel to second inclination 33*j*. As shown in FIGS. 31 and 32, opposing part 33*z* (33*g*, 33*h*, 33*i*, 33*j*, 33*k*, 33*m*) is connected to the lower end of arcuate part 33*f*, and faces falling part 33*e* as a whole.

In accordance with the embodiment, when header 20 is engaged with socket 30, as illustrated in FIG. 32, header-side power source terminal 23 is inserted into between reversed U-shaped part 33*c* and arcuate projection 33*k*. At this moment, falling part 33*e*, arcuate part 33*f*, flat part 33*g*, first inclination 33*h*, arcuate part 33*i*, second inclination 33*j*, arcuate projection 33*k*, and tip end part 33*m*, are integrated with each other and function as the spring. The spring (33*e*, 33*f*, 33*g*, 33*h*, 33*i*, 33*j*, 33*k*, 33*m*) elastically deforms when the projection of header-side power source terminal 23 is inserted into the recess in socket-side power source terminal 33.

Accordingly, the distance between arcuate projection 33*k* and each of falling part 33*e* and reversed U-shaped part 33*c* increases. At this moment, locked part 23*e* of header-side power source terminal 23 is inserted more deeply than locking part 33*d* of socket-side power source terminal 33. Accordingly, arcuate projection 33*k* of socket-side power source terminal 33 is engaged with recess 23*c* of header-side power source terminal 23.

While header-side power source terminal 23 is engaged with socket-side power source terminal 33, the spring which elastically deforms generates a restoring force. The restoring force causes arcuate projection 33*k* to press header-side power source terminal 23 to each of falling part 33*e* and reversed U-shaped part 33*c*. Accordingly, header-side power source terminal 23 is nipped by socket-side power source terminal 33. At this moment, header-side power source terminal 23 contacts each of reversed U-shaped part 33*c*, falling part 33*e*, and arcuate projection 33*k* of socket-side power source terminal 33.

Figure 33B:
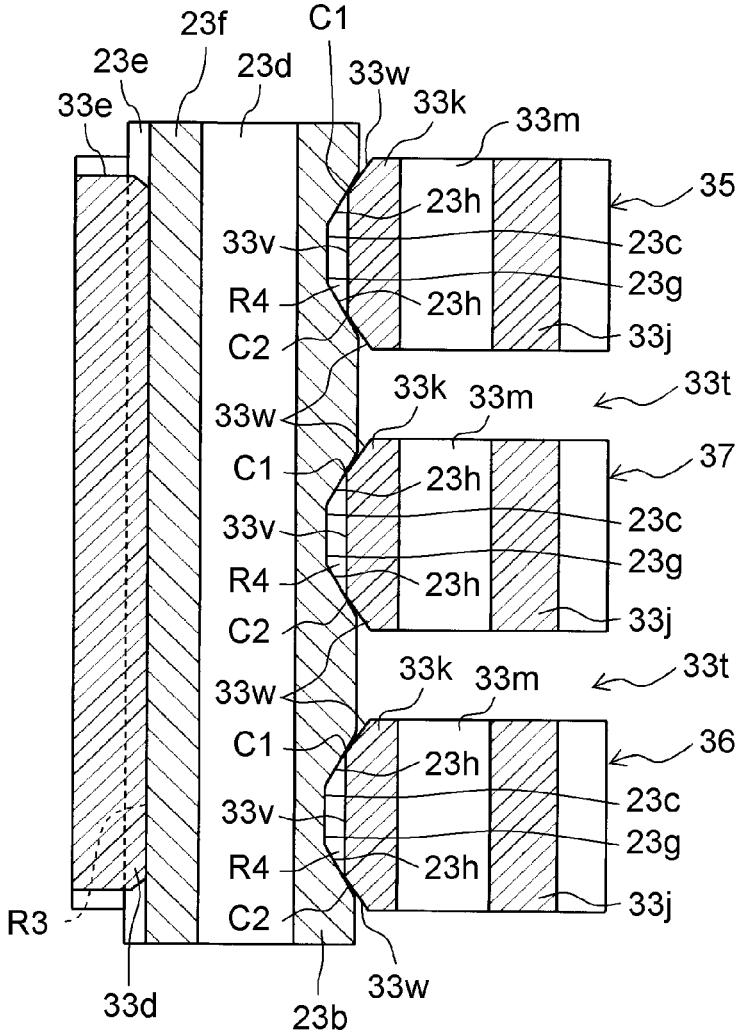
FIG. 33B is a lateral sectional view of the connector according to the embodiment of the present invention for schematically illustrating a contact state between the terminals according to the embodiment of the present invention and a contact state between the header-side power source terminal and the socket-side power source terminal.

As illustrated in FIGS. 31, 33A, and 33B, tip end part 23*d* of header-side power source terminal 23 contacts falling part 33*e* of socket-side power source terminal 33. In other words, contact portion R3 of socket-side power source terminal 33 contacts contact portion R3 of header-side power source terminal 23.

Recess 23*c* in header-side power source terminal 23 contacts arcuate projection 33*k* of socket-side power source terminal 33. In other words, contact portion R4 of socket-side power source terminal 33 contacts contact portion R4 of header-side power source terminal 23.

Header-side power source terminal 23 thus contacts socket-side power source terminal 33 at plural contact points (contact portions R3 and R4) which are separated from each other in the width direction Y. This configuration provides electrical connection between header-side power source terminal 23 and socket-side power source terminal 33 with high reliability.

Figure 26A:
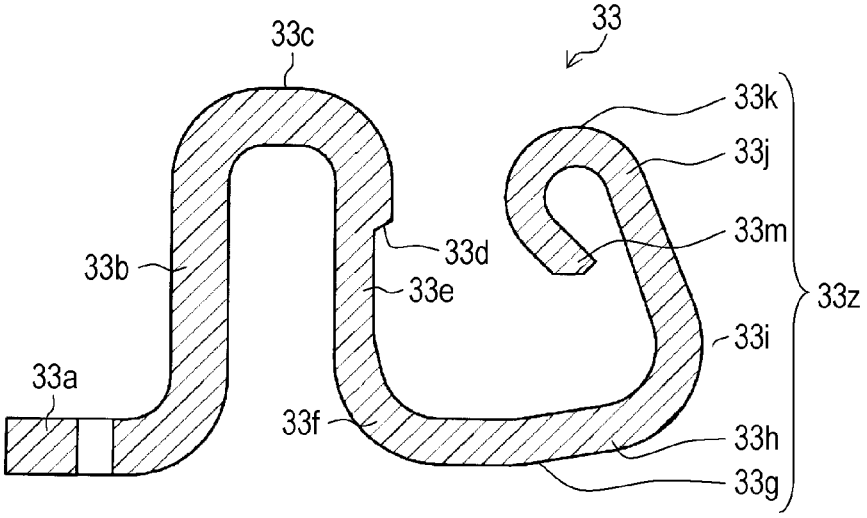
FIG. 26A is a side sectional view of the socket-side power source terminal of the connector according to the embodiment of the present invention.
Figure 26B:
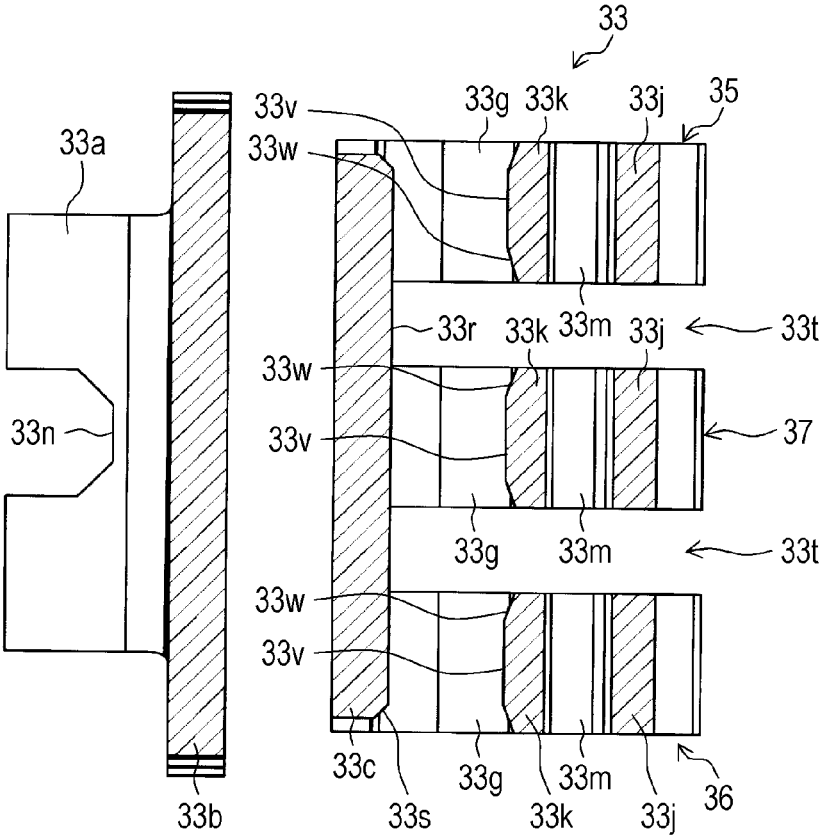
FIG. 26B is a lateral sectional view of the socket-side power source terminal of the connector according to the embodiment of the present invention.
Figure 27A:
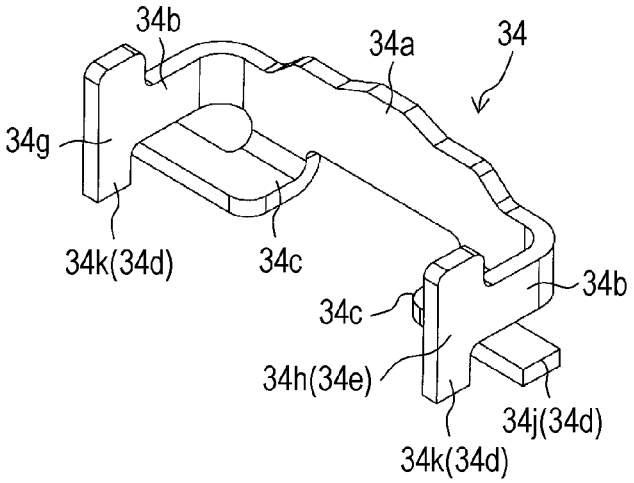
FIG. 27A is a first perspective view of a socket-side holder bracket of the connector according to the embodiment of the present invention.
Figure 27B:
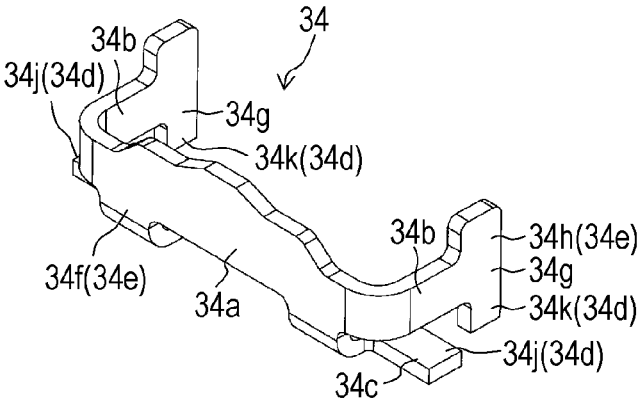
FIG. 27B is a second perspective view of the socket-side holder bracket of the connector according to the embodiment of the present invention.
Figure 27C:
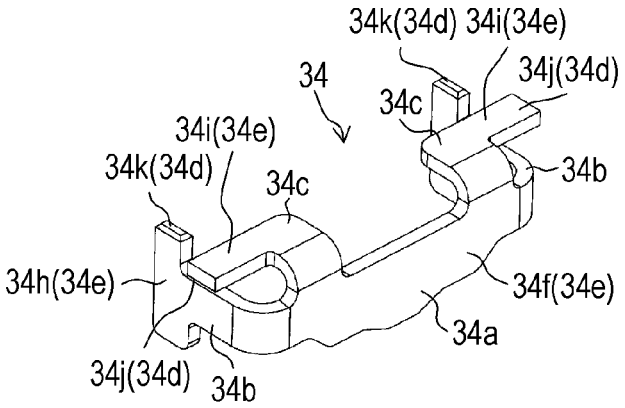
FIG. 27C is a third perspective view of the socket-side holder bracket of the connector according to the embodiment of the present invention.
Figure 27D:
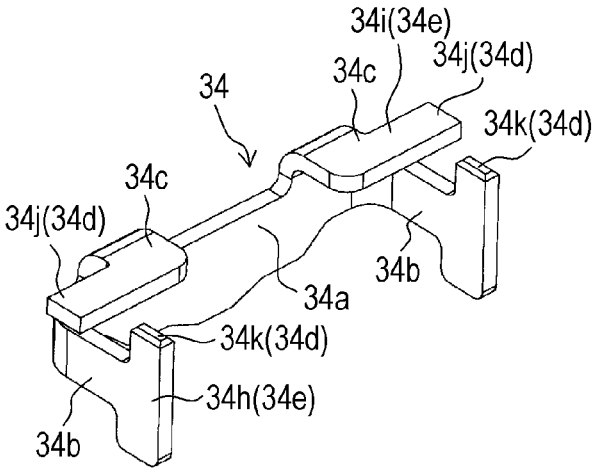
FIG. 27D is a fourth perspective view of the socket-side holder bracket of the connector according to the embodiment of the present invention.
Figure 28:
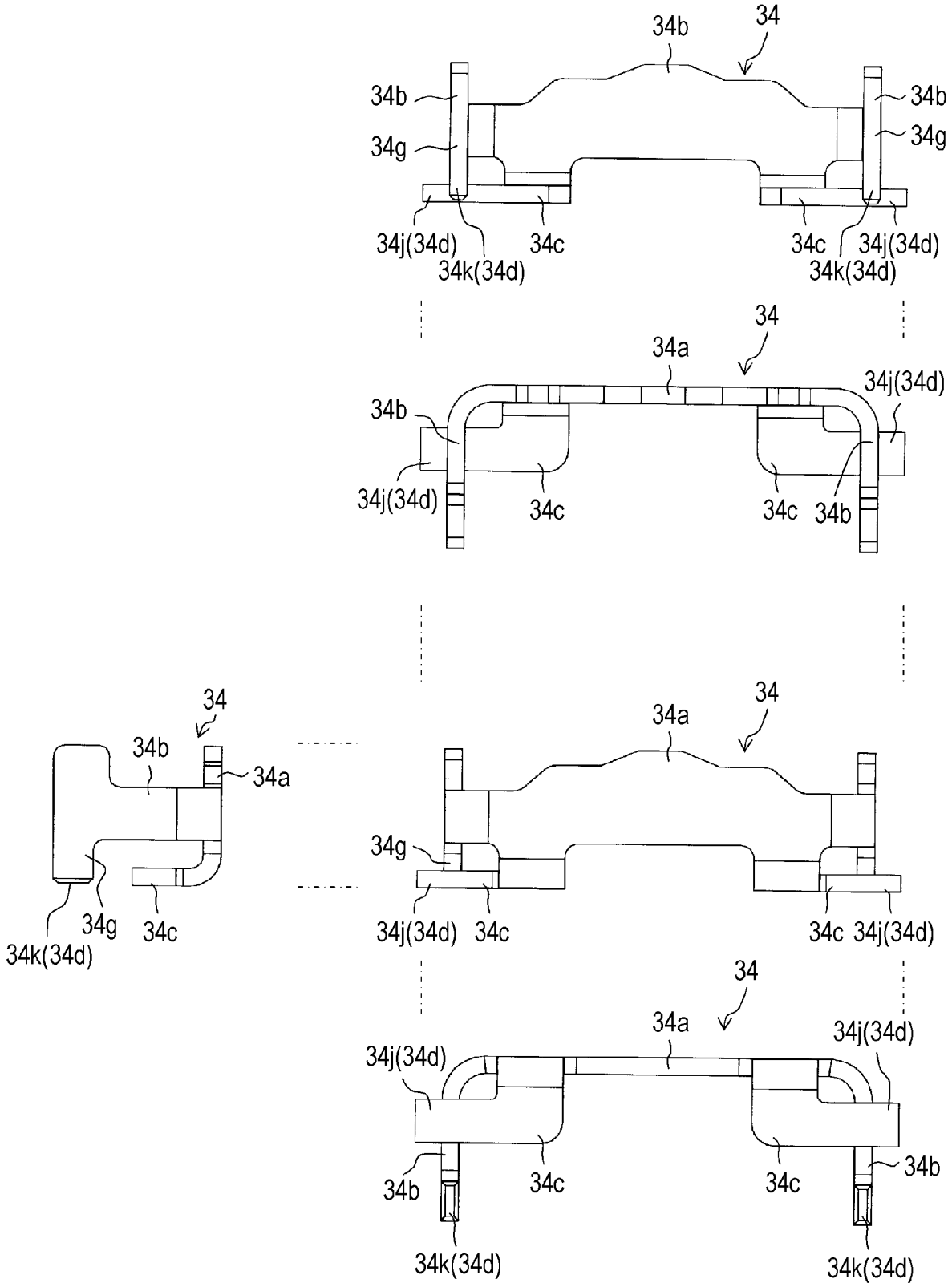
FIG. 28 illustrates the socket-side holder bracket of the connector according to the embodiment of the present invention.

In accordance with the embodiment, the shape of the side cross section of socket-side signal terminal 32 is substantially identical to the shape of the side cross section of socket-side power source terminal 33 (refer to FIGS. 23A and 26A).

As described above, socket-side signal terminal 32 and socket-side power source terminal 33 are arranged in longitudinal direction X of socket housing 31. In accordance with the embodiment, width socket-side power source terminal 33 in longitudinal direction X of socket housing 31 is larger than the width of socket-side signal terminal 32 in longitudinal direction X.

In accordance with the embodiment, the width of socket-side signal terminal 32 in longitudinal direction X of socket housing 31 is smaller than the width of socket-side power source terminal 33 in longitudinal direction X. In accordance with the embodiment, the width of the entire socket-side signal terminal 32 in longitudinal direction X of socket housing 31 is smaller than the width of socket-side power source terminal 33 in longitudinal direction X.

Since the width of socket-side power source terminal 33 in longitudinal direction X of socket housing 31 is large, recess 33*n* is formed in the center of base part 33*a* in the longitudinal direction X. Recess 33*n* can increase the length of a border line contacting a circuit pattern of base part 33*a* while suppressing the increase in a protrusion of base part 33*a*. The shape of the border line can have a complicated shape. This configuration, compared to a case where recess 33*n* is not formed, increases the fixing strength between base part 33*a* and circuit pattern 61 with solder 70 when wide socket-side power source terminal 33 is fixed to circuit pattern 61 of first circuit board 60 with solder 70.

In accordance with the embodiment, locking part 33*d* is formed from one end to the other end of socket-side power source terminal 33 in longitudinal direction X of socket housing 31. In other words, locking part 33*d* having a step is formed across the entire width direction of wide socket-side power source terminal 33. This configuration can improve a locking force by locked part 23*e* of header-side power source terminal 23 and locking part 33*d* of socket-side power source terminal 33. When repeating insertion and pulling out of header 20 and socket 30, since the friction of locking part 33*d* is unlikely to occur, it is also possible to achieve a long service life of a product.

In accordance with the embodiment, the spring (33*e*, 33*f*, 33*g*, 33*h*, 33*i*, 33*j*, 33*k*, 33*m*) includes the U-shaped part (33*e*, 33*f*, 33*g*, 33*h*, 33*i*, and 33*j*) and a free end (33*k*, 33*m*) which is connected to one end (33*j* side) of the U-shaped part (33*e*, 33*f*, 33*g*, 33*h*, 33*i*, 33*j*). Contact portion R4 of socket-side power source terminal 33 is provided at arcuate projection 33*k* of the free end (33*k*, 33*m*).

Socket-side power source terminal 33 thus includes the U-shaped part (33*e*, 33*f*, 33*g*, 33*h*, 33*i*, 33*j*), and the free end (33*k*, 33*m*) including contact portion R4 is connected to one end (33*j* side) of the U-shaped part (33*e*, 33*f*, 33*g*, 33*h*, 33*i*, 33*j*).

Three tongues 35, 36, and 37 are formed at least at the free end (33*k*, 33*m*).

In accordance with the embodiment, three tongues 35, 36, and 37 are provided at a part of the spring (33*e*, 33*f*, 33*g*, 33*h*, 33*i*, 33*j*, 33*k*, 33*m*) by two grooves 33*t* having belt shapes.

Three tongues 35, 36, and 37 have flexibility, and can be bent independently of each other.

Contact portion R4 is provided at each of three tongues 35, 36, and 37. In accordance with the embodiment, plural contact portions R4 which contact each other are provided at socket-side power source terminal 33 and header-side power source terminal 23. Specifically, contact portions R4 are provided at three locations arranged in longitudinal direction X of socket housing 31.

In accordance with the embodiment, bottom part 33*u* of groove 33*t* is positioned at the middle of falling part 33*e*. In other words, bottom part 33*u* of groove 33*t* is closer to the free end (33*k* and 33*m*) than to locking part 33*d*.

This configuration allows the free end (33*k* and 33*m*) to have spring characteristics without reduction of a locking force by locking part 33*d*.

Positions at which tongues 35, 36, and 37 start to branch (positions of bottom parts 33*u* of grooves 33*t*) may be provided at an arbitrary position on the spring (33*e*, 33*f*, 33*g*, 33*h*, 33*i*, 33*j*, 33*k*, amd 33*m*).

Figure 38C:
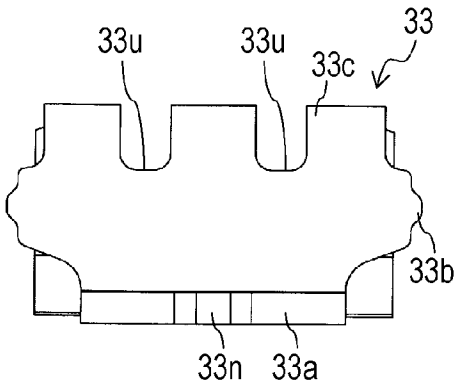
FIG. 38C is a front view of the socket-side power source terminal shown in FIG. 38A.
Figure 38B:
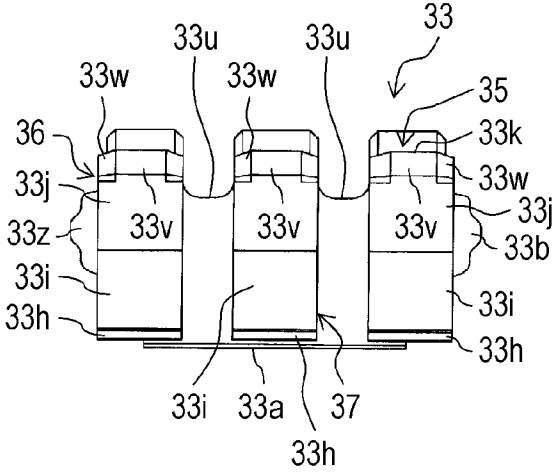
FIG. 38B is a back view of the socket-side power source terminal shown in FIG. 38A.
Figure 38A:
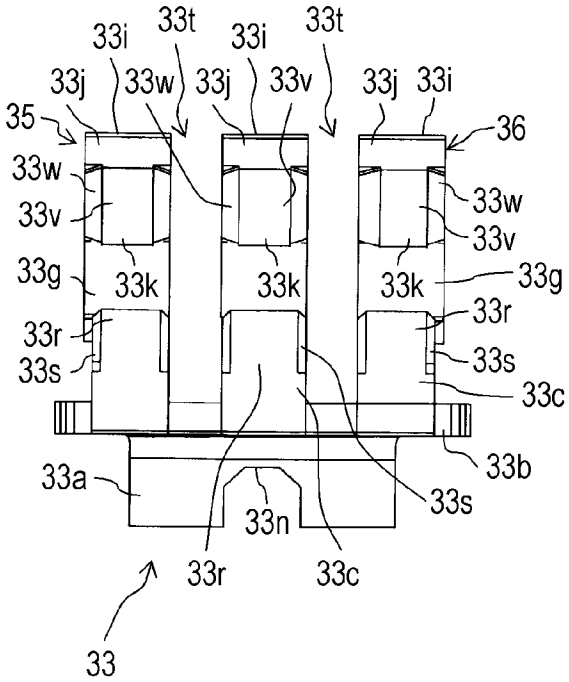
FIG. 38A is a plan view of a modification of the socket-side power source terminal according to the embodiment.

For example, as shown in FIGS. 38A to 38C, bottom part 33*u* of groove 33*t* may extend to reversed U-shaped part 33*c* (to a border between reversed U-shaped part 33*c* and rising part 33*b*). In this case, three locking parts 33*d* are arranged in the width direction of socket-side power source terminal 33 (in the longitudinal direction X of socket housing 31).

Two partition walls 31*r* are formed in each socket-side power source terminal accommodation recess 31*n*. When pressing and inserting socket-side power source terminal 33 into socket-side power source terminal accommodator 31*g*, partition wall 31*r* is inserted into groove 33*t*, and suppresses interference of three tongues 35, 36, and 37.

In accordance with the embodiment, recess 23*c* is formed in contact portion R4 of header-side power source terminal 23 which is one contact portion out of contact portion R4 of socket-side power source terminal 33 and contact portion R4 of header-side power source terminal 23 which contact each other. Contact portion R4 of socket-side power source terminal 33 which is the other contact point out of contact portion R4 of socket-side power source terminal 33 and contact portion R4 of header-side power source terminal 23 contact both end parts of recess 23*c* in longitudinal direction X of socket housing 31.

As illustrated in FIG. 33B, when arcuate projection 33*k* of socket-side power source terminal 33 is engaged with recess 23*c*, a boundary part between tip end surface 33*v* of arcuate projection 33*k* and inclined surface 33*w* contacts inclined surface 23*h*. In accordance with the embodiment, contact portion R4 of socket-side power source terminal 33 thus contacts two points (contact point C1 and contact point C2) at contact portion R4 of header-side power source terminal 23.

In accordance with the embodiment, any one of three contact portions R4 at three locations which are formed to be separated from each other along the longitudinal direction X contacts two points (contact point C1 and contact point C2).

The elastic deformation of the spring may cause a boundary part between flat part 33*g* and first inclination 33*h* to contact first circuit board 60 not only at contact portion R3 and contact portion R4 but also at contact portion R5.

Socket-side power source terminal 33 can be formed by performing molding and bending a metal material having a strip shape having a predetermined thickness.

Socket-side power source terminal 33 is mounted on socket housing 31 by pressing and inserting socket 30 to socket-side power source terminal accommodator 31*g* from the rear side (the lower side of FIG. 15) of socket housing 31 when assembling socket 30.

Socket-side power source terminal 33 may be mounted on socket housing 31 by, e.g. insert molding socket-side power source terminal 33 in socket housing 31.

Next, a configuration of socket-side holder bracket 34 will be described with reference to FIGS. 27A to 27D and 28.

Socket-side holder bracket 34 can be formed by bending and forming a holder bracket plate formed by press-molding a metal plate having a predetermined thickness, and includes side plate 34*a* which extends in the width direction Y of connector 10, and bottom plate 34*c* having a lower side which is curved substantially perpendicularly to side plate 34*a* toward a center of side plate 34*a* in longitudinal direction X. Both end parts of bottom plate 34*c* protrude to the outside from both sides in the width direction Y of connector 10, thereby forming first mounting terminal 34*j* which serves as mounting terminal 34*d*.

At both end parts of side plate 34*a* in width direction Y, extending part 34*b* which is made by bending both end parts of side plate 34*a* in width direction Y substantially perpendicularly toward the center of side plate 34*a* in longitudinal direction X of connector 10. Second mounting terminal 34*k* which serves as mounting terminal 34*d* that extends downward and is fixed to first circuit board 60 by solder 70 is provided in final part 34*g* in the extending direction of extending part 34*b*.

In accordance with the embodiment, four groups each including first mounting terminal 34*j* and second mounting terminal 34*k* disposed close to first mounting terminal 34*j* are provided at both ends in the longitudinal direction X of each of one pair of long sides of connector 10 while being arranged with socket-side terminal group G2.

In accordance with the embodiment, socket-side holder bracket 34 includes first mounting terminal 34*j* configured to be fixed onto first circuit board 60, and second mounting terminal 34*k* which is separate from first mounting terminal 34*j* and is configured to be fixed onto first circuit board 60. Second mounting terminal 34*k* extends from extending part 34*b* of socket-side holder brackets 34.

At this moment, second mounting terminal 34*k* is provided at a position away from first mounting terminals 34*j* by a distance along the outer surface of socket-side holder bracket 34 from first mounting terminal 34*j* which constitute a group such that the distance becomes maximum.

In accordance with the embodiment, socket-side holder bracket 34 is mounted (disposed) on socket housing 31 by the insert molding. At this moment, at least a part of socket-side holder brackets 34 is exposed along socket housing 31.

In other words, at least a part of socket-side holder brackets 34 is exposed from outer surface 31*s* of socket housing 31.

In accordance with the embodiment, a part of outer surface 31*s* of circumferential wall 31*b* and plate wall 31*a* and a part of outer wall surface 34*e* of socket-side holder bracket 34 are substantially flush with each other. In other words, socket-side holder brackets 34 is molded to be integrated with socket housing 31 such that a part of outer wall surface 34*e* of socket-side holder brackets 34 is exposed and substantially flush with outer surface 31*s* of circumferential wall 31*b*.

Specifically, an upper part of outer surface 34*f* of side plate 34*a* is exposed and is flush with side surface 31*t* which extends to the outmost end in the X direction (longitudinal direction) of socket housing 31 (end surface in the longitudinal direction). Outer wall surface 34*e* (outer surface 34*h*) of extending part 34*b* is exposed from the outer surface of circumferential wall 31*b* (outer surface 31*s* of longitudinal direction wall 31*h*) while being flush with the outer surface of circumferential wall 31*b*. In accordance with the embodiment, socket-side holder brackets 34 is exposed along at least one surface out of side surface 31*t* and bottom surface 31*u* of socket housing 31.

Outer surface 34*i* of bottom plate 34*c* is exposed and is not flush with bottom surface 31*u* (outer surface 31*s*) of socket housing 31, but outer surface 34*i* of bottom plate 34*c* may be exposed and be flush with bottom surface 31*u* (outer surface 31*s*) of socket housing 31. Outer wall surface 34*e* of socket-side holder brackets 34 is not necessarily exposed to the outer surface of circumferential wall 31*b* (outer surface 31*s* of lateral direction wall 31*i* or outer surface 31*s* of longitudinal direction wall 31*h*). Even if being exposed, outer wall surface 34*e* of socket-side holder brackets 34 is not necessarily exposed while being flush with the outer surface of circumferential wall 31*b* (outer surface 31*s* of lateral direction wall 31*i* or outer surface 31*s* of longitudinal direction wall 31*h*).

As illustrated in FIGS. 30 and 32, circumferential wall 21*b* of header housing 21 is inserted to and engaged with engaging groove 31*d* of socket housing 31 as to engage header 20 with socket 30.

When header 20 is engaged with socket 30, for example, tapered part 31*e* and tapered part 21*d* which are formed at a long side part on one end side in the Y direction (width direction:lateral direction) can overlap each other, and can be engaged with each other while being shifted to the other end in the Y direction (width direction:lateral direction). This configuration allows tapered part 31*e* and tapered part 21*d* to function as guiders for easily engaging header 20 with socket 30.

While header 20 is engaged with socket 30, contact portion R1 of socket-side signal terminal 32 contacts contact portion R1 of header-side signal terminal 22.

Contact portion R2 of socket-side signal terminal 32 contacts contact portion R2 of header-side signal terminal 22.

Contact portion R3 of socket-side power source terminal 33 contacts contact portion R3 of header-side power source terminal 23.

Contact portion R4 of socket-side power source terminal 33 contacts contact portion R4 of header-side power source terminal 23.

As a result, socket-side signal terminal 32 is electrically connected to header-side signal terminal 22 while socket-side power source terminal 33 is electrically connected to header-side power source terminal 23.

Circuit pattern 61 of first circuit board 60 is thus connected electrically to circuit pattern 41 of second circuit board 40.

When disengaging header 20 from socket 30, both of header 20 and socket 30 are pulled in directions for peeling off header 20 from socket 30. Then, while locking part 32*d* having a step slides on locked part 22*e* having a step, the spring (32*e*, 32*f*, 32*g*, 32*h*, 32*i*, 32*j*, 32*k*, 32*m*) of socket-side signal terminal 32 elastically deforms and releases the locked state of locking part 33*d* and locked part 23*e*. At this moment, the engaging state of arcuate projection 32*k* to recess 22*c* is also released.

While locking part 33*d* having a step slides on locked part 23*e* having a step, the spring (33*e*, 33*f*, 33*g*, 33*h*, 33*i*, 33*j*, 33*k*, 33*m*) of socket-side power source terminal 33 elastically deforms, and releases the locked state of locking part 33*d* and locked part 23*e*. At this moment, the engaging state of arcuate projection 33*k* to recess 23*c* is also released.

Header 20 can be thus separated from socket 30.

In accordance with the embodiment, as described above, header-side holder bracket 24 is disposed at both end parts of header housing 21 in longitudinal direction X while socket-side holder brackets 34 is disposed at both end parts of socket housing 31 in longitudinal direction X. Header-side holder bracket 24 and socket-side holder brackets 34 are used for increasing the strength of header housing 21 and socket housing 31, and being attached and fixed to the above-described circuit board.

In accordance with the embodiment, mounting terminal 24*a* of header-side holder bracket 24 is soldered to second circuit board 40 as to assemble header 20 rigidly with second circuit board 40.

Mounting terminal 34*d* of socket-side holder brackets 34 is soldered to first circuit board 60 as to assemble socket 30 rigidly with first circuit board 60.

The above configuration allows header 20 and socket 30 rigidly assembled with the circuit boards to be engaged with each other. Header-side signal terminal 22 is consequently connected electrically to socket-side signal terminal 32 while header-side power source terminal 23 is consequently connected electrically to socket-side power source terminal 33, thereby electrically connecting circuit patterns of the circuit boards to each other.

Next, a fixing structure of each terminal and each holder bracket to the circuit pattern will be described with reference to FIGS. 34 to 37. The fixing structure of each terminal and each holder bracket to the circuit pattern is not limited to the states shown in FIGS. 34 to 37.

Figure 34:
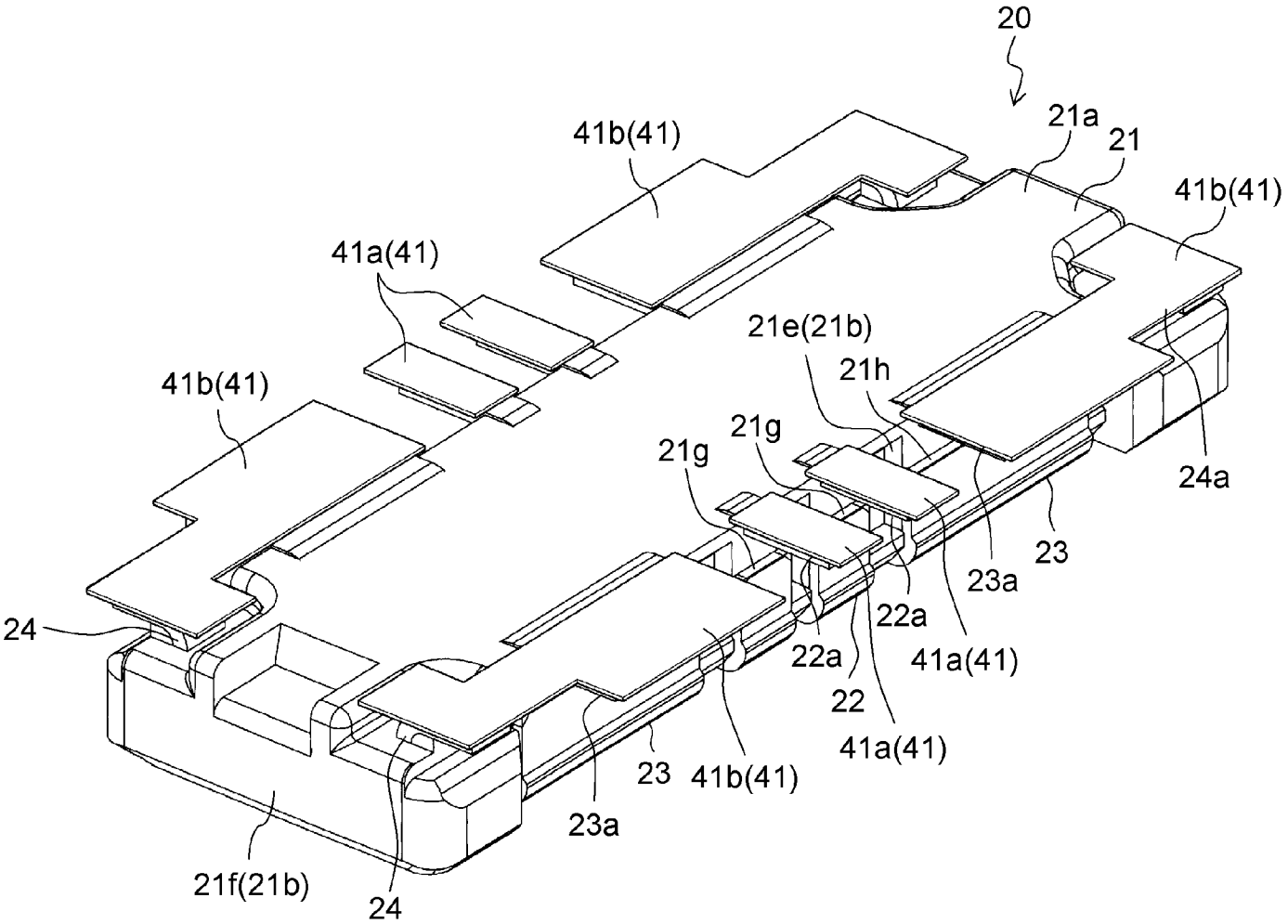
FIG. 34 is a perspective view of the connector according to the embodiment of the present invention for schematically illustrating a connection state between each terminal of the header and the circuit pattern.

As illustrated in FIG. 34, header-side signal terminal 22, header-side power source terminal 23, and header-side holder bracket 24 can be fixed to circuit pattern 41.

In header-side signal terminal 22 disposed at the center in the longitudinal direction X, base part 22*a* is fixed to circuit pattern 41*a* for a signal with solder 50.

In header-side power source terminal 23 disposed at both sides in the longitudinal direction X, base part 23*a* is fixed to common circuit pattern 41*b* with solder 50. In header-side holder bracket 24, mounting terminal 24*a* is also fixed to common circuit pattern 41*b* with solder 50.

As shown in FIG. 34, mounting terminal 24*a* and base part 23*a* are soldered to common circuit pattern 41*b*.

As shown in FIG. 34, header-side power source terminal 23 and header-side holder bracket 24 which are disposed to be adjacent to each other are soldered to common circuit pattern 41*b*. In other words, header-side power source terminal 23 and header-side holder bracket 24 which are disposed to be adjacent to each other commonly use circuit pattern 41*b*.

Therefore, two header-side power source terminals 23 disposed on one side in the longitudinal direction X are electrically connected to each other via circuit pattern 41*b* disposed on one side in the longitudinal direction X and header-side holder bracket 24 disposed on one side in the longitudinal direction X. Two header-side power source terminals 23 disposed on the other side in the longitudinal direction X are electrically connected to each other via circuit pattern 41*b* disposed on the other side in the longitudinal direction X and header-side holder bracket 24 disposed on the other side in the longitudinal direction X.

Figure 35:
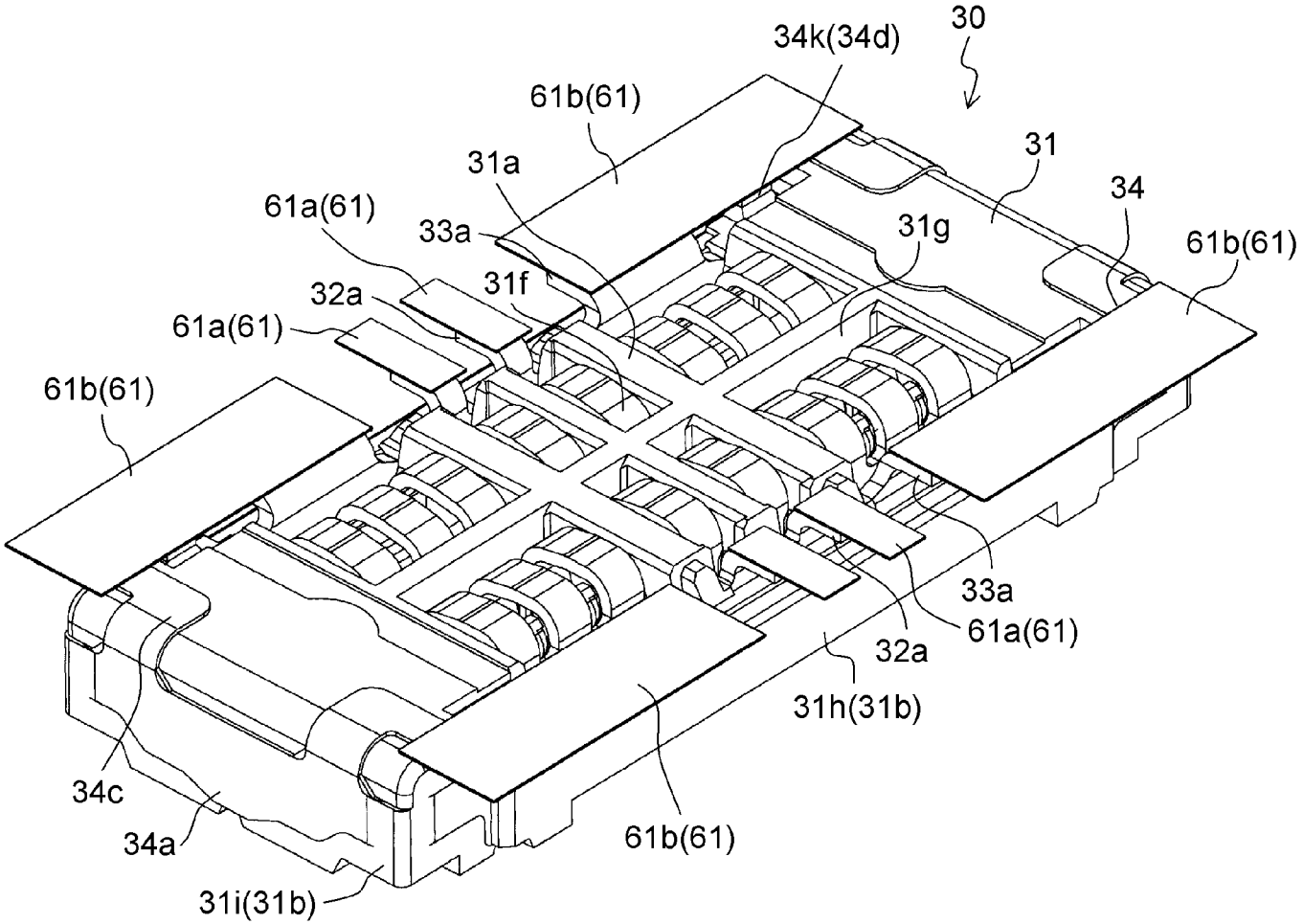
FIG. 35 is a perspective view of the connector according to the embodiment of the present invention for schematically illustrating a connection state between each terminal of the socket and the circuit pattern.

As illustrated in FIG. 35, socket-side signal terminal 32, socket-side power source terminal 33, and socket-side holder brackets 34 can be fixed to circuit pattern 61.

In socket-side signal terminal 32 disposed at the center in the longitudinal direction X, base part 32*a* is fixed to circuit pattern 61*a* for each signal with solder 70.

In socket-side power source terminal 33 disposed on both sides in the longitudinal direction X, base part 33*a* is fixed to common circuit pattern 61*b* with solder 70. In socket-side holder brackets 34, mounting terminal 34*d* is also fixed to common circuit pattern 61*b* with solder 70.

As shown in FIG. 35, mounting terminal 34*d* and base part 33*a* are soldered to common circuit pattern 61*b*.

As shown in FIG. 35, socket-side power source terminal 33 and socket-side holder brackets 34 which are adjacent to each other are soldered to common circuit pattern 61*b*. Therefore, two socket-side power source terminals 33 disposed on one side in the longitudinal direction X are electrically connected to each other via circuit pattern 61*b* disposed on one side in the longitudinal direction X and socket-side holder brackets 34 disposed on one side in the longitudinal direction X. Two socket-side power source terminals 33 disposed on the other side in the longitudinal direction X are also electrically connected to each other via circuit pattern 61*b* disposed on the other side in the longitudinal direction X and socket-side holder brackets 34 disposed on the other side in the longitudinal direction X.

In accordance with the embodiment, first mounting terminal 34*j* and second mounting terminal 34*k* which constitute a group together are soldered to circuit pattern 61*b* to which base part 33*a* is soldered.

Figure 36:
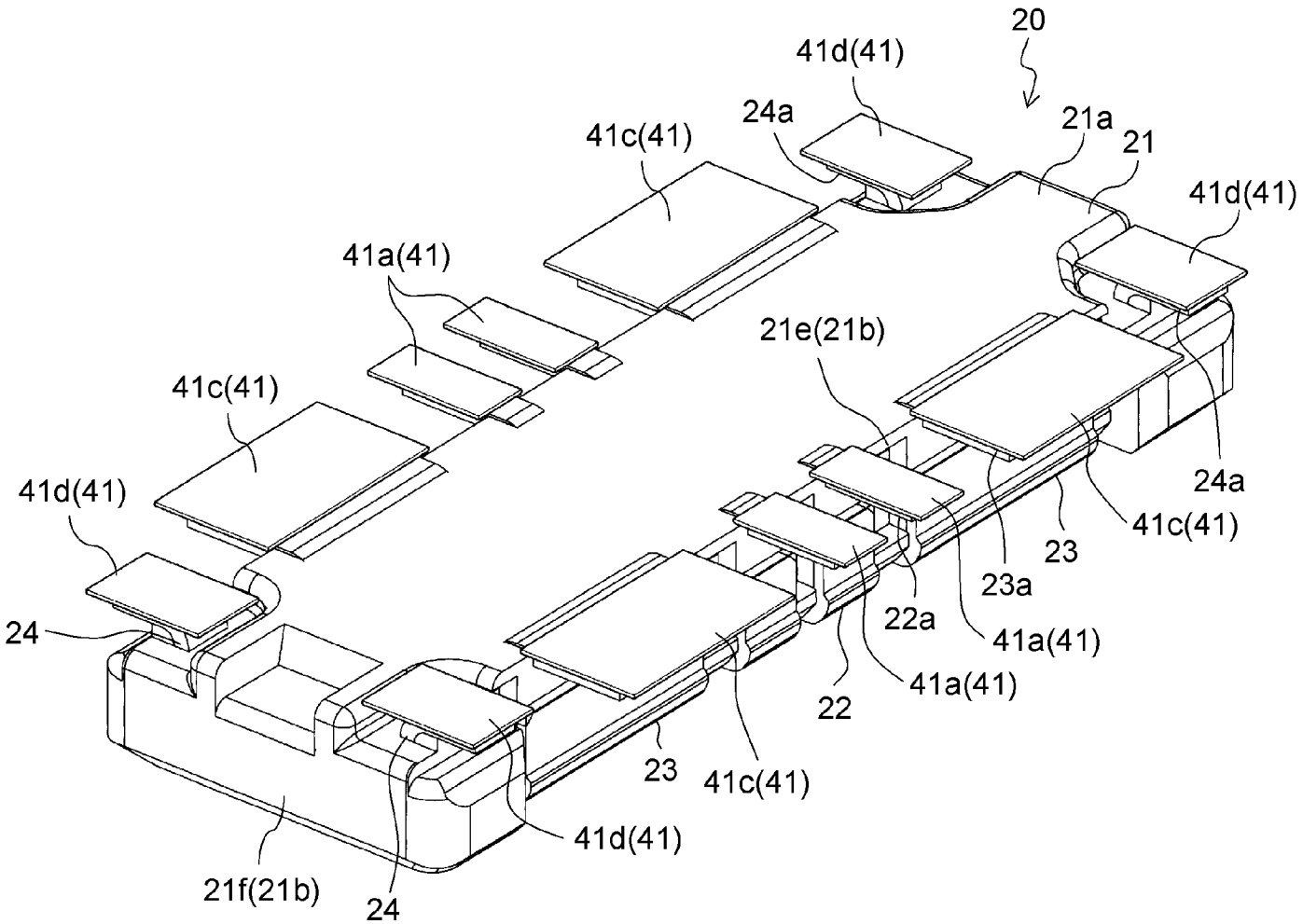
FIG. 36 is a perspective view of the connector according to the embodiment of the present invention for schematically illustrating another connection state between each terminal of the header and the circuit pattern.

As illustrated in FIG. 36, header-side signal terminal 22, header-side power source terminal 23, and header-side holder bracket 24 can be fixed to circuit pattern 41.

In header-side signal terminal 22 disposed at the center in the longitudinal direction X, base part 22*a* is fixed to circuit pattern 41*a* for signals with solder 50.

In header-side power source terminals 23 disposed on both sides in the longitudinal direction X, base part 23*a* is configured to be fixed to circuit pattern 41*c* for power with solder 50.

In header-side holder bracket 24, mounting terminal 24*a* is configured to be fixed to circuit pattern 41*d* for fixing a bracket with solder 50.

As shown in FIG. 36, mounting terminal 24*a* and base part 23*a* are separately soldered to different circuit patterns 41.

Figure 37:
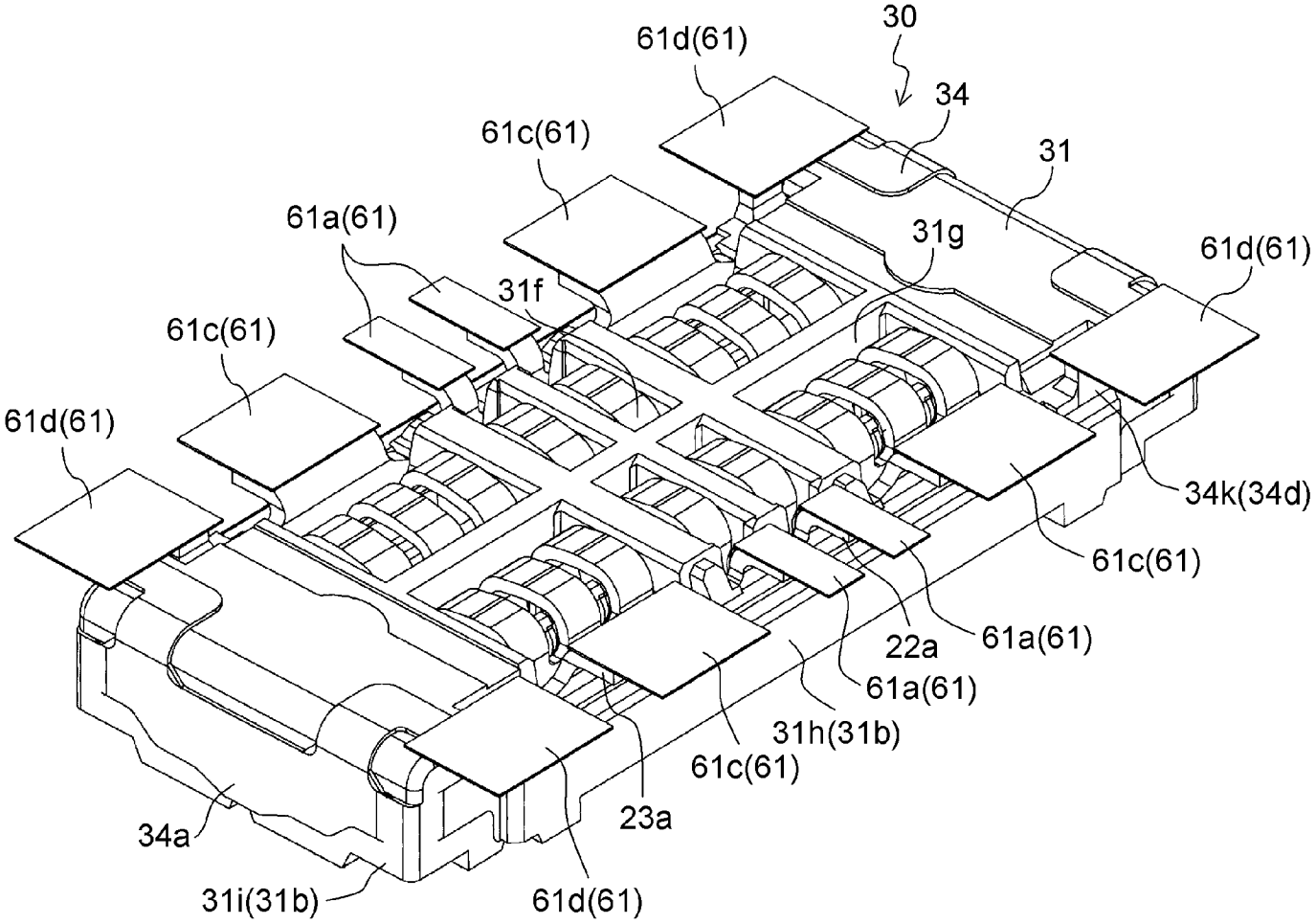
FIG. 37 is a perspective view of the connector according to the embodiment of the present invention for schematically illustrating another connection state between each terminal of the socket and the circuit pattern.

As illustrated in FIG. 37, socket-side signal terminal 32, socket-side power source terminal 33, and socket-side holder brackets 34 can also be fixed to circuit pattern 61.

In socket-side signal terminal 32 disposed at the center in the longitudinal direction X, base part 32*a* is fixed to circuit pattern 61*a* for signal with solder 70.

In socket-side power source terminals 33 disposed on both sides in the longitudinal direction X, base part 33*a* is fixed to circuit pattern 61*c* for power source by solder 70.

In socket-side holder brackets 34, mounting terminal 34*d* is also fixed to circuit pattern 61*d* for engaging a bracket with solder 70.

In FIG. 37, mounting terminal 34*d* and base part 33*a* are separately soldered to different circuit patterns 61.

Any of the structures shown in FIGS. 34 and 36 is selected as the fixing structure on the socket-side while any of the structures shown in FIGS. 35 and 37 is selected as the fixing structure on the header-side. Both structures may be combined with each other to fix connector 10 to the circuit patterns.

As described above, connector 10 in accordance with the embodiment includes socket 30 and header 20. Socket 30 includes socket housing 31 having substantially a rectangular shape in which socket-side signal terminal 32 and socket-side power source terminal 33 are disposed. Header 20 includes header housing 21 having substantially a rectangular shape in which header-side signal terminal 22 and header-side power source terminal 23 are disposed.

Socket-side signal terminal 32 and socket-side power source terminal 33 are arranged in longitudinal direction X of socket housing 31. Socket-side signal terminal 32 has a width in longitudinal direction X of socket housing 31 is smaller than a width of socket-side power source terminal 33 in longitudinal direction X.

Compared with a connector in which plural terminals are separately from each other and are also used as a power source terminal, the above configuration does not create a useless space, accordingly providing socket 30 with a small size in longitudinal direction X.

A cross section of socket-side signal terminal 32 has a shape identical to the shape of a cross section of socket-side power source terminal 33. This configuration improves component workability, and assembly workability.

Plural rows of socket-side terminal groups G2 each including socket-side signal terminal 32 and socket-side power source terminal 33 which are arranged in longitudinal direction X of socket housing 31 are disposed in socket housing 31.

This configuration increases a sectional area of the terminal, and increases a current capacity accordingly.

Socket-side power source terminal 33 has locking part 33*d* having a step locked to header-side power source terminal 23. Locking part 33*d* is formed from one end to the other end of socket-side power source terminal 33 in longitudinal direction X of socket housing 31.

This configuration improves the locking force, and additionally, the friction at repetitive insertion and pulling out is unlikely to be generated, thus providing a long service life of a product.

Socket-side power source terminal 33 is disposed farther to the outside in longitudinal direction X of socket housing 31 than socket-side signal terminal 32.

This configuration allows socket-side power source terminal 33 having a large heating capacity is disposed at the outside in longitudinal direction X of socket housing 31, consequently increasing efficiency of heat dissipation.

In socket-side power source terminal 33 and header-side power source terminal 23, plural contact portions R4 which contact each other are arranged in longitudinal direction X of socket housing 31.

This configuration improves contact reliability of the terminals, and reduces contact resistances accordingly.

In socket-side power source terminal 33, three tongues 35, 36, and 37 are formed, and contact portions R4 are provided at each of three tongues 35, 36 and 37.

This configuration improves contact reliability of the terminals, and reduces contact resistances accordingly.

Three tongues 35, 36, and 37 have flexibility, and can be bent independently of each other.

This configuration improves contact reliability of the terminals, and reduces contact resistances accordingly.

Socket-side power source terminal 33 includes the U-shaped part (33*e*, 33*f*, 33*g*, 33*h*, 33*i*, 33*j*). The free end (33*k*, 33*m*) including contact portion R4 is connected to one end (33*j* side) of the U-shaped part (33*e*, 33*f*, 33*g*, 33*h*, 33*i*, 33*j*). Three tongues 35, 36, and 37 are formed at least at the free end (33*k*, 33*m*).

This configuration improves contact reliability of the terminals.

Recess 23*c* is formed at contact point (contact portion R4 of header-side power source terminal 23) which is one contact portion out of contact portion R4 of socket-side power source terminal 33 and contact portion R4 of header-side power source terminal 23 which contact each other. In addition, the other contact portion (contact portion R4 of socket-side power source terminal 33) out of contact portion R4 of socket-side power source terminal 33 and contact portion R4 of header-side power source terminal 23 contacts both end parts (contact points C1 and C2) of recess 23*c* in longitudinal direction X of socket housing 31.

This configuration improves contact reliability of terminals.

In socket housing 31, socket-side holder brackets 34 is disposed, and at least a part (34*a*, 34*b*, and 34*c*) of socket-side holder brackets 34 is exposed along outer surface 31*s* of socket housing 31.

This configuration reduces the size of the socket housing, and allows the socket housing to be fixed rigidly to the socket-side holder bracket.

Socket-side holder bracket 34 is exposed along at least one surface out of side surface 31*t* and bottom surface 31*u* of socket housing 31.

This configuration reduces the size of the socket housing, and allows the socket housing to be fixed rigidly to the socket-side holder bracket.

Socket-side holder brackets 34 are disposed in socket housing 31 by insert-molding.

As a result, the socket housing is fixed rigidly to the socket holder bracket. The contact area with the socket housing is larger than press-engaging, and improves heat dissipation.

Socket-side holder brackets 34 includes mounting terminal 34*d* configured to be soldered to circuit pattern 61 of first circuit board 60. Socket-side power source terminal 33 includes base part 33*a* configured to be soldered to circuit pattern 61 of first circuit board 60. Mounting terminal 34*d* and base part 33*a* are soldered to common circuit pattern 61*b*.

This configuration allows the circuit pattern to which socket-side holder brackets 34 is fixed to be used as a heatsink dissipating heat generated by socket-side power source terminal 33, thus further improving heat dissipation.

Socket-side holder bracket 34 is adjacent to socket-side power source terminal 33.

This configuration improves heat dissipation and additionally, prevents the shapes of the circuit patterns from be complicated.

Mounting terminal 34*d* includes first mounting terminal 34*j* and second mounting terminal 34*k* separate from first mounting terminal 34*j*.

This configuration allows socket-side holder brackets 34 to be fixed rigidly to first circuit board 60.

At this moment, when first mounting terminal 34*j* and second mounting terminal 34*k* are soldered to circuit pattern 61*b* to which base part 33*a* is soldered, it is possible to improve the efficiency of heat dissipation.

Header-side signal terminal 22 and header-side power source terminal 23 are arranged in longitudinal direction X of header housing 21. Header-side signal terminal 22 has a width in longitudinal direction X of header housing 21 is smaller than a width of header-side power source terminal 23 in longitudinal direction X.

Compared to a case where plural terminals separate from each other are used as power source terminals, the above configuration reduces a useless space, accordingly reducing the size of header 20 in longitudinal direction X.

Since the shape of a section of header-side signal terminal 22 is substantially identical to the shape of a section of header-side power source terminal 23, component workability is improved, and assembly workability is also improved.

In header housing 21, plural rows of header-side terminal groups G1 each including header-side signal terminal 22 and header-side power source terminal 23 arranged in longitudinal direction X of header housing 21.

This configuration increases the area of a section of the terminal, accordingly increasing a current capacity.

Header-side power source terminal 23 includes locked part 23*e* having a step locked to socket-side power source terminal 33. Locked part 23*e* is formed from one end to the other end of header-side power source terminal 23 in longitudinal direction X of header housing 21.

This configuration improves the locking force, and additionally, the friction generated due to repetitive insertion and pulling out is unlikely to be generated, and provides a long service life of a product.

Header-side power source terminal 23 which is disposed farther to the outside in the longitudinal direction X of header housing 21 than header-side signal terminal 22. The header-side power source terminal having a large heat capacity on the outside in the longitudinal direction of the header housing, hence increasing efficiency of heat dissipation.

In header housing 21, header-side holder bracket 24 is disposed. Header-side holder bracket 24 includes mounting terminal 24*a* soldered to circuit pattern 41 of second circuit board 40. Header-side power source terminal 23 includes base part 23*a* soldered to circuit pattern 41 of second circuit board 40. Mounting terminal 24*a* and base part 23*a* are soldered to common circuit pattern 41*b*.

This configuration allows the circuit pattern to which header-side holder bracket 24 is fixed to be used as a heatsink for dissipating heat generated by header-side power source terminal 23, thus improving heat dissipation.

Header-side holder bracket 24 and header-side power source terminal 23 are adjacent to each other.

This configuration improves heat dissipation, and additionally, prevents the shape of the circuit pattern from be complicated.

In above, a preferable embodiment of the present invention is described, but the present invention is not limited to the above-described embodiment, and various modifications are possible.

For example, in the above-described embodiment, an example in which header 20 has a structure symmetrical with respect to the center of header 20 in a plan view, and socket 30 has a structure symmetrical with respect to the center of socket 30 in a plan view (a connector which does not have polarity).

However, the present invention can be applied to a connector having polarity (a connector having a shape not the same when rotating by 180 degrees).

While header 20 is engaged with socket 30, the header-side holder bracket can be engaged with the socket-side holder bracket.

The socket-side housing or the header-side housing, and specifications (shape, size, or layout) of other specific parts, can be appropriately modified.

REFERENCE MARKS IN THE DRAWINGS

10 connector
20 header
21 header housing
22 header-side signal terminal
22*a* base part
22*c* recess
22*e* locked part
23 header-side power source terminal
23*a* base part
23*c* recess
23*e* locked part
24 header-side holder bracket
24*a* mounting terminal
30 socket
31 socket housing
31*s* outer surface
31*t* side surface
31*u* bottom surface
32 socket-side signal terminal
32*a* base part
33 socket-side power source terminal
33*a* base part
34 tongue
35 tongue
36 socket-side holder bracket
34*d* mounting terminal

34*j* first mounting terminal
34*k* second mounting terminal
34*e* outer wall
34*f* outer surface
40 second circuit board
41 circuit pattern
50 solder
60 first circuit board
61 circuit pattern
70 solder
R1-R5 contact portion
C1, C2 contact point
X longitudinal direction
Y lateral direction (width direction)
Z upward-and-downward direction

The invention claimed is:

1. A connector comprising:

a socket including a socket housing having substantially a rectangular shape, a socket-side signal terminal disposed in the socket housing, and a socket-side power source terminal disposed in the socket housing; and a header including a header housing having substantially a rectangular shape, a header-side signal terminal disposed in the header housing, and a header-side power source terminal disposed in the header housing, wherein, while the socket housing is engaged with the header housing, the socket-side signal terminal contacts the header-side signal terminal, and the socket-side power source terminal contacts the header-side power source terminal, wherein the socket-side signal terminal and the socket-side power source terminal are arranged in a longitudinal direction of the socket housing, wherein the socket-side power source terminal and the header-side power source terminal include a plurality of contact portions which contact each other and arranged in the longitudinal direction, wherein the socket-side power source terminal further includes three tongues, wherein the plurality of contact portions are provided at the three tongues, respectively, wherein a recess is formed in one contact portion out of a contact portion of the socket-side power source terminal and a contact portion of the header-side power source terminal which contacts the contact portion of the socket-side power source terminal, and wherein at least one of the three tongues contacts with the header-side power source terminal at the recess.

2. The connector according to claim 1, wherein a socket-side terminal group including a plurality of rows each including the socket-side signal terminal and the socket-side power source terminal arranged in the longitudinal direction is disposed in the socket housing.

3. The connector according to claim 1, wherein the three tongues have flexibility to be bendable independently of each other.

4. The connector according to claim 1, wherein the socket-side power source terminal has a U-shape having one end having a free end connected thereto, the plurality of contact portions being provided at the free end, and wherein the three tongues is formed at least at the free end.

5. The connector according to claim 1, wherein two other contact portions out of the contact portion of the socket-side power source terminal and the contact portion of the header-side power source contacts the one contact portion at both end portions of the recess in the longitudinal direction.

6. The connector according to claim 1, wherein a recess is formed on the header-side power source terminal.

* * * * *